US012582230B2

(12) United States Patent
Crum et al.

(10) Patent No.: US 12,582,230 B2
(45) Date of Patent: Mar. 24, 2026

(54) CHAIR AND MECHANISM WITH IMPROVED OTTOMAN POSITIONING

(71) Applicant: L&P PROPERTY MANAGEMENT COMPANY, South Gate, CA (US)

(72) Inventors: Michael Andrew Crum, Mantachie, MS (US); Gregory Mark Lawson, Tupelo, MS (US); Cheston Brett Crawford, Randolph, MS (US)

(73) Assignee: L&P PROPERTY MANAGEMENT COMPANY, Carthage, MO (US)

( * ) Notice: Subject to any disclaimer, the term of this patent is extended or adjusted under 35 U.S.C. 154(b) by 245 days.

(21) Appl. No.: 18/373,371

(22) Filed: Sep. 27, 2023

(65) Prior Publication Data

US 2024/0108136 A1 Apr. 4, 2024

Related U.S. Application Data

(60) Provisional application No. 63/463,971, filed on May 4, 2023, provisional application No. 63/412,952, filed on Oct. 4, 2022.

(51) Int. Cl.
*A47C 1/0355* (2013.01)
*A47C 1/024* (2006.01)

(52) U.S. Cl.
CPC ..... *A47C 1/0242* (2013.01); *A47C 1/0355* (2013.01)

(58) Field of Classification Search
CPC ..... A47C 1/035; A47C 1/0355
USPC ..... 297/423.2
See application file for complete search history.

(56) References Cited

U.S. PATENT DOCUMENTS 115,787 A * 6/1871 Travis ..... A47C 7/506 297/423.2
408,118 A * 7/1889 Lord ..... A47C 1/026 297/423.32
516,110 A * 3/1894 Pynchon ..... A47C 1/032 297/423.32
556,343 A * 3/1896 Fleer et al. ..... A47C 1/03205 297/423.32
665,005 A * 1/1901 Harmon ..... A47C 7/5066 297/423.32
RE11,906 E * 4/1901 Harmon ..... 297/423.32
806,678 A * 12/1905 Kelly ..... A47C 7/506 297/423.2
917,184 A * 4/1909 Tate ..... A47C 7/5062 297/423.2

(Continued)

OTHER PUBLICATIONS

International Preliminary Report on Patentability received for PCT Patent Application No. PCT/US2023/075496, mailed on Apr. 17, 2025, 9 pages.

(Continued)

*Primary Examiner* — Rodney B White
(74) *Attorney, Agent, or Firm* — SHOOK, HARDY & BACON L.L.P.

(57) ABSTRACT

An all-linkage mechanism for a seating unit is provided that allows the ottoman to be extended between a closed position and an extended position, with the top face of the ottoman facing upwardly during the entire motion. The mechanism is motorized, and may be stopped in a position intermediate the closed and extended positions, such as a laptop position. The mechanism is compact, allowing use on a high-leg, wood-to-the-floor seating unit.

22 Claims, 38 Drawing Sheets

(56) References Cited

U.S. PATENT DOCUMENTS

| | | | | |
|---|---|---|---|---|
| 1,984,281 | A * | 12/1934 | Poggendorf | A47C 1/032 297/423.32 |
| 4,061,397 | A * | 12/1977 | Lewis | A47C 1/035 297/68 |
| 4,696,512 | A * | 9/1987 | Burnett | A47C 1/035 |
| 4,826,243 | A | 5/1989 | Lawson | |
| 6,557,934 | B2 * | 5/2003 | Wiecek | A47C 1/0352 297/84 |
| 8,419,122 | B2 * | 4/2013 | Lawson | A47C 1/035 |
| 9,241,571 | B2 * | 1/2016 | Robertson | A47C 1/031 |
| 9,326,606 | B2 * | 5/2016 | LaPointe | A47C 1/024 |
| 9,848,704 | B1 * | 12/2017 | Pollard | A47C 31/008 |
| 10,334,951 | B2 * | 7/2019 | Robertson | A47C 1/0355 |
| 10,405,660 | B2 * | 9/2019 | Robertson | A47C 1/035 |
| 10,959,524 | B2 * | 3/2021 | Fischer | A61G 5/14 |
| 11,969,095 | B2 * | 4/2024 | Liu | A47C 1/035 |
| 2005/0023869 | A1 | 2/2005 | Longnecker | |
| 2005/0052067 | A1 * | 3/2005 | Grimm | A47C 17/134 297/423.2 |
| 2014/0091601 | A1 | 4/2014 | Breen et al. | |
| 2014/0333108 | A1 * | 11/2014 | Fischer | A47C 1/0352 297/423.32 |
| 2018/0242741 | A1 | 8/2018 | Lawson | |
| 2019/0038039 | A1 | 2/2019 | Gu et al. | |
| 2020/0113333 | A1 | 4/2020 | Crum et al. | |
| 2022/0015543 | A1 | 1/2022 | Bryant | |

OTHER PUBLICATIONS

International Search Report and Written Opinion received for PCT Patent Application No. PCT/US2023/075496, mailed on Jan. 12, 2024, 14 pages.

* cited by examiner

CHAIR AND MECHANISM WITH IMPROVED OTTOMAN POSITIONING

CROSS-REFERENCE TO RELATED APPLICATIONS

This application claims the benefit of U.S. Provisional Application No. 63/412,952, filed Oct. 4, 2022, and U.S. Provisional Application No. 63/463,971, filed May 4, 2023, both entitled Chair and Mechanism with Improved Ottoman Positioning, the entireties of which are incorporated by reference herein.

TECHNICAL FIELD

Aspects herein relate to a chair and a mechanism for use on a chair that has an improved ottoman motion and positioning.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "recliners." More particularly, the present invention relates to an improved all-linkage powered reclining mechanism allowing a high-leg styling (with its slim profile) and clean look, and that also allows an improved ottoman motion and positioning.

Recliners exist that typically provide three basic positions: a normal non-reclined sitting position with the seat generally horizontal and the back substantially upright; a partially reclined position often referred to as a "TV" position with an extended ottoman and with the seat and back disposed in a slightly reclined position but with the back still sufficiently upright to permit comfortable television viewing from the recliner; and a fully reclined position with the back pivoted toward horizontal into an obtuse relationship with the seat for lounging or sleeping. However, these recliners typically have an ottoman that rotates from the closed position with a top face (the portion on which a user rests his or her feet in the TV position) of the ottoman facing either forward (with the ottoman generally vertical) or generally downwardly, to the TV position, with the top face of the ottoman facing generally upwardly. It would also be desirable to provide a recliner mechanism with a low profile that allows a high-leg styling, while also providing a recliner mechanism where the ottoman can be placed in an intermediate position between the closed position and the TV position, with the ottoman below the top of the seat, but with the top face of the ottoman facing upwardly. In this improved motion, it would be desirable for the top face of the ottoman to face generally upwardly from the closed position all the way to the fully reclined position. Further, it would be desirable to provide a recliner mechanism that achieves such a motion using an all-linkage design, without using an expensive track-and-roller design. In other aspects, it would also be desirable to provide an ottoman movable between a closed, stowed position and an extended position, without also moving the seat or back, but while still orienting the ottoman such that the top face of the ottoman faces generally upwardly from the closed position to the extended position (allowing intermediate positions between the closed and extended positions with the top face of the ottoman facing upwardly).

BRIEF DESCRIPTION OF THE DRAWINGS

Examples of aspects herein are described in detail below with reference to the attached drawings figures, wherein.

DETAILED DESCRIPTION

Figure 1:
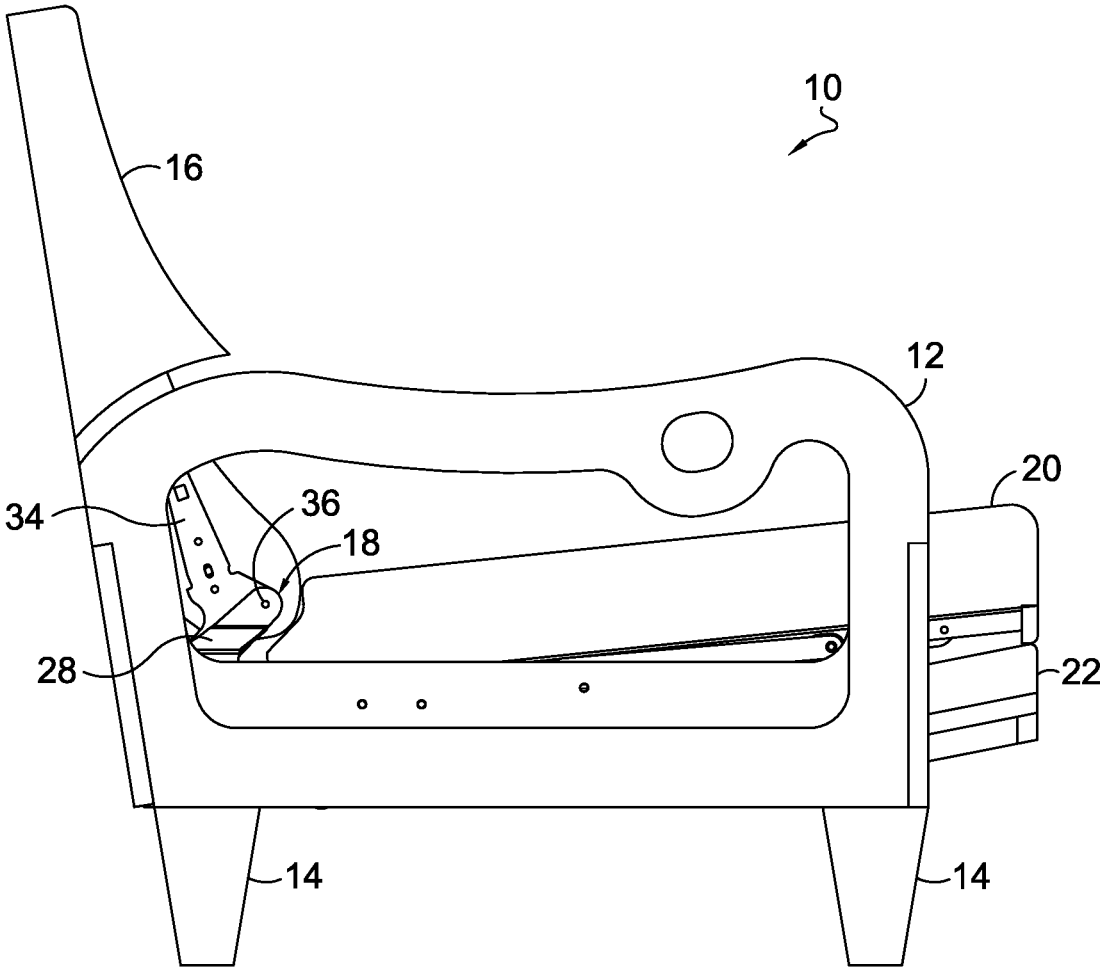
FIG. 1 illustrates a side view of a chair (shown without some upholstery) in the closed position, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies.

FIGS. 1-7 depict a chair 10 in a closed position, FIGS. 8-12 depict the chair 10 in an intermediate laptop position, FIGS. 13-16 depict the chair 10 in an extended or TV position, and FIGS. 17-21 depict the chair 10 in a reclined position. The chair 10 is shown without upholstery on the arms and back, for simplicity. The chair 10 may include a pair of spaced apart arms 12, suspended above the floor by legs 14. The arms 12 are shown as a wooden frame that would in practice have padding and upholstery, which is not shown here for the sake of simplicity. While the arms 12 are shown as having a stylistic shape, it should be understood that other shapes and styles could be used for the arms 12. As shown, the bottoms of the arms are suspended above the floor by the legs 14, in a styling known as "high-leg". The chair 10 further includes a back 16 pivotally coupled between the arms 12 via a mechanism generally designated as 18. The mechanism 18 further carries a seat 20 and an ottoman 22 between the arms 12. The mechanism 18 is an all-linkage assembly, and controls the movement of the chair 10 between the closed position (FIG. 1), the laptop position (FIG. 8), the TV position (FIG. 13) and the reclined position (FIG. 17), as further described below. While depicted as four distinct positions, in practice a user could position the chair 10 in any position between the closed position and the reclined position.

Figure 4:
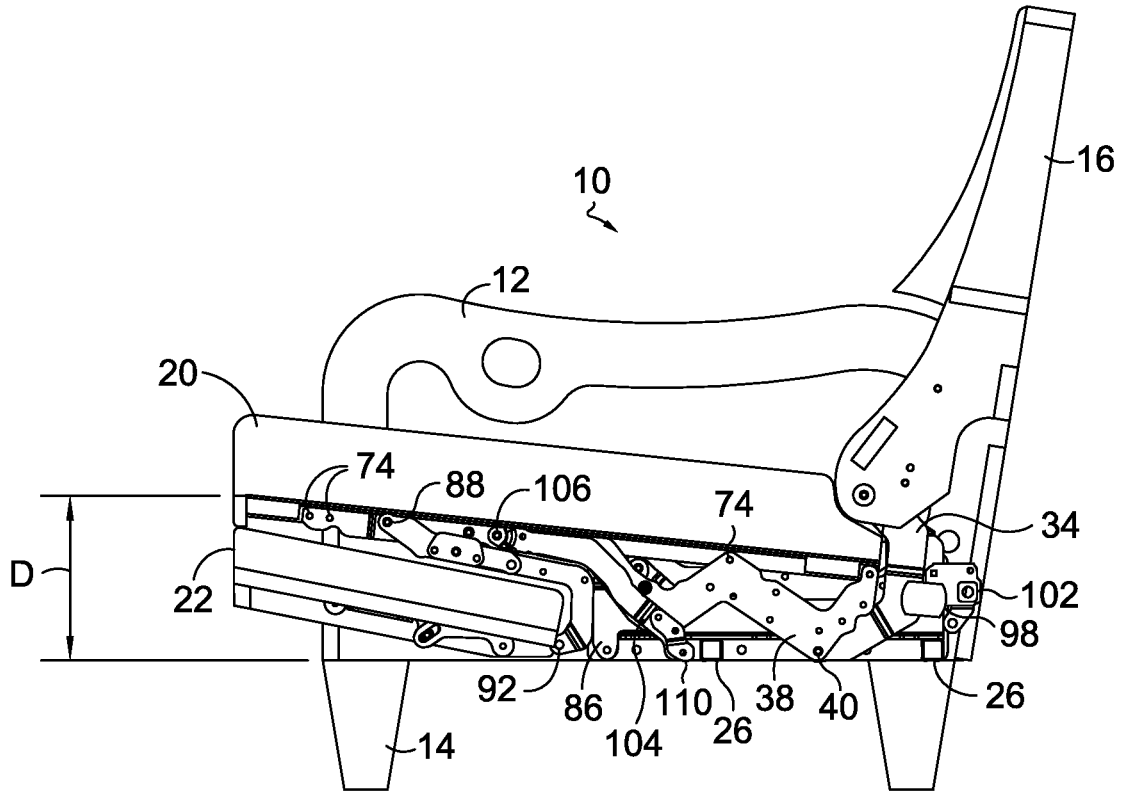
FIG. 4 is a view similar to FIG. 3, but with the ottoman pitch control link and the main ottoman link hidden, in accordance with aspects herein.
Figure 9:
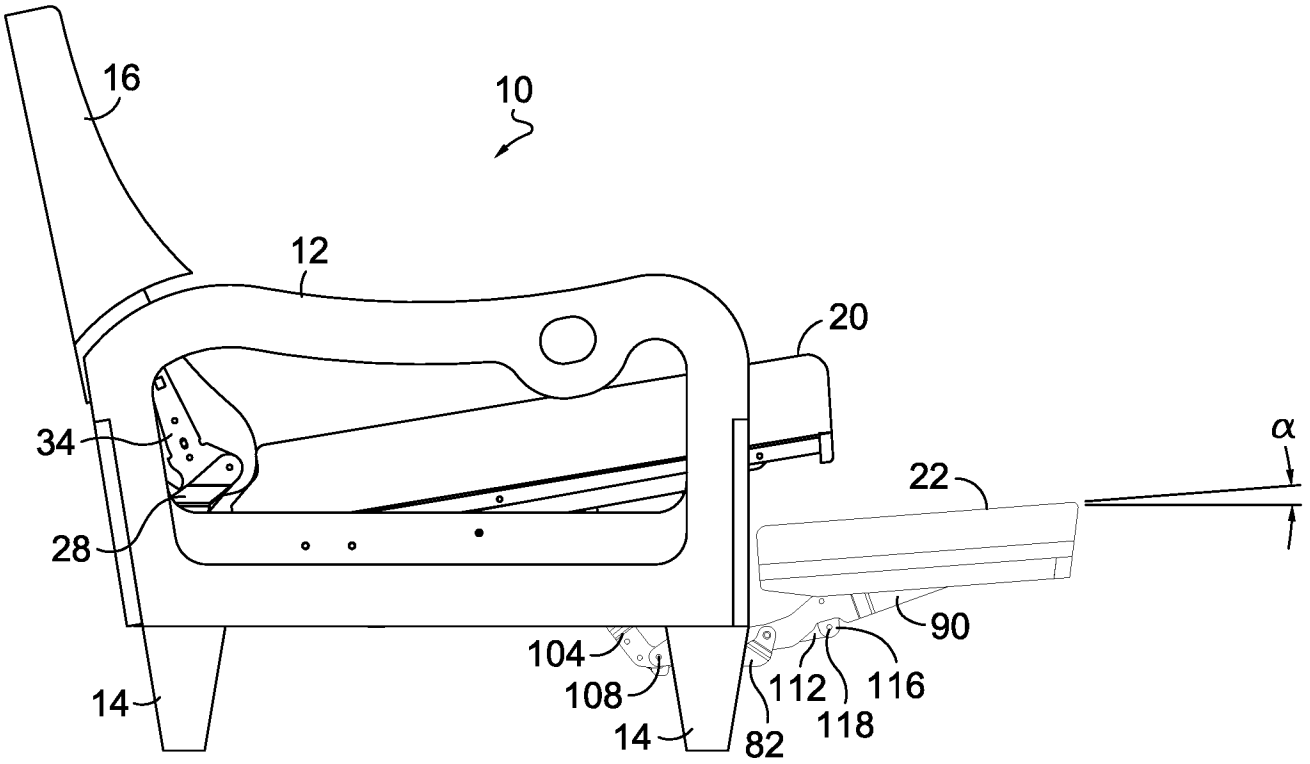
FIG. 9 is a side view with the chair and mechanism in the position of FIG. 8, in accordance with aspects herein.

In this movement, the mechanism 18 moves the ottoman 22 from the closed position, such as that shown in FIG. 4, to the laptop position, such as that shown in FIG. 9, with the top face of the ottoman facing in an upward direction throughout the movement. In general, the terms 'upward' and 'downward' refer to vertical directions with respect to a floor or surface that supports the recliner or with respect to the legs of the recliner. For example, 'upward' refers to a direction moving away from the floor and legs and toward a top portion of the back 16. 'Downward' refers to a direction moving away from the top of the back 16 and toward the floor or toward the legs of the recliner. Further, the terms 'front' or 'frontward' generally refer to a direction toward an end of the seat 20 or ottoman 22 farthest from the back 16, and the terms 'rear,' 'rearward,' 'back,' or 'backward' generally refer to the direction toward the end of the seat 20 or ottoman 22 nearest the back 16. This improved motion of the ottoman 22 allows for usable positions between the closed position and the TV position (such as the laptop position). In some aspects, the mechanism 18 moves the ottoman 22 while maintaining the ottoman 22 at a slight angle, with respect to the horizontal plane of the floor, the angle being defined as rising from the back of the ottoman 22 to the front of the ottoman 22, for comfortable support of a user's feet. In some aspects, this angle can range between 0-15 degrees, although other angles could also be implemented. The mechanism 18 could also be altered to adjust the angle (or pitch) of the ottoman 22 to suit particular design considerations. For example, in some aspects, the mechanism 18 could orient the ottoman 22 to be inclined slightly downwardly from the back of the ottoman to the front of the ottoman in the TV or extended position. In some aspects, the mechanism 18 allows the linkage carrying the ottoman 22 to be located inwardly, with respect to outer edges of the ottoman 22, for a better aesthetic. As shown in FIG. 4, the mechanism 18 allows use on a high-leg chair with a clean bottom line (with the mechanism 18 hidden from view by the bottom of the arms 12). The mechanism 18 is also designed to have a compact design in the closed position of FIG. 4, with a distance D from the bottom extent of the mechanism 18 to the top extent of the mechanism 18 of less than 8 inches, and in some aspects less than 7.75 inches. A distance D of less than 8 inches provides a compact design, allowing a taller leg 14 without increasing the seat height, and adds to the styling and design options available for the chair 10. Still further, the design of the mechanism 18 allows the ottoman 22 to span the full width of the seat 20 for the full depth of the ottoman 22. In some aspects, the mechanism 18 moves the ottoman 22 to the TV and reclined positions, such as that shown in FIGS. 14 and 21, with the top face of the ottoman 22 at a height equal to or greater than the top of the seat 20, and with the back of the ottoman 22 spaced from the front of the seat 20 (the distance between the front-most point of the seat 20 and the rear-most point of the ottoman 22 defining a gap labeled "G" in FIG. 21) less than that requiring the use of a mid-ottoman support. Eliminating the mid-ottoman support eliminates one cross-member, and allows the chair 10 to have a unitary or one-piece ottoman 22. The mechanism 18 further allows a wing-back design that allows the wing-back (such as back 16) to pivot over stationary arms (such as arms 12). It should be understood that while a wing-back design is an option in designing the chair 10 with the mechanism 18, it is not required.

Figure 5:
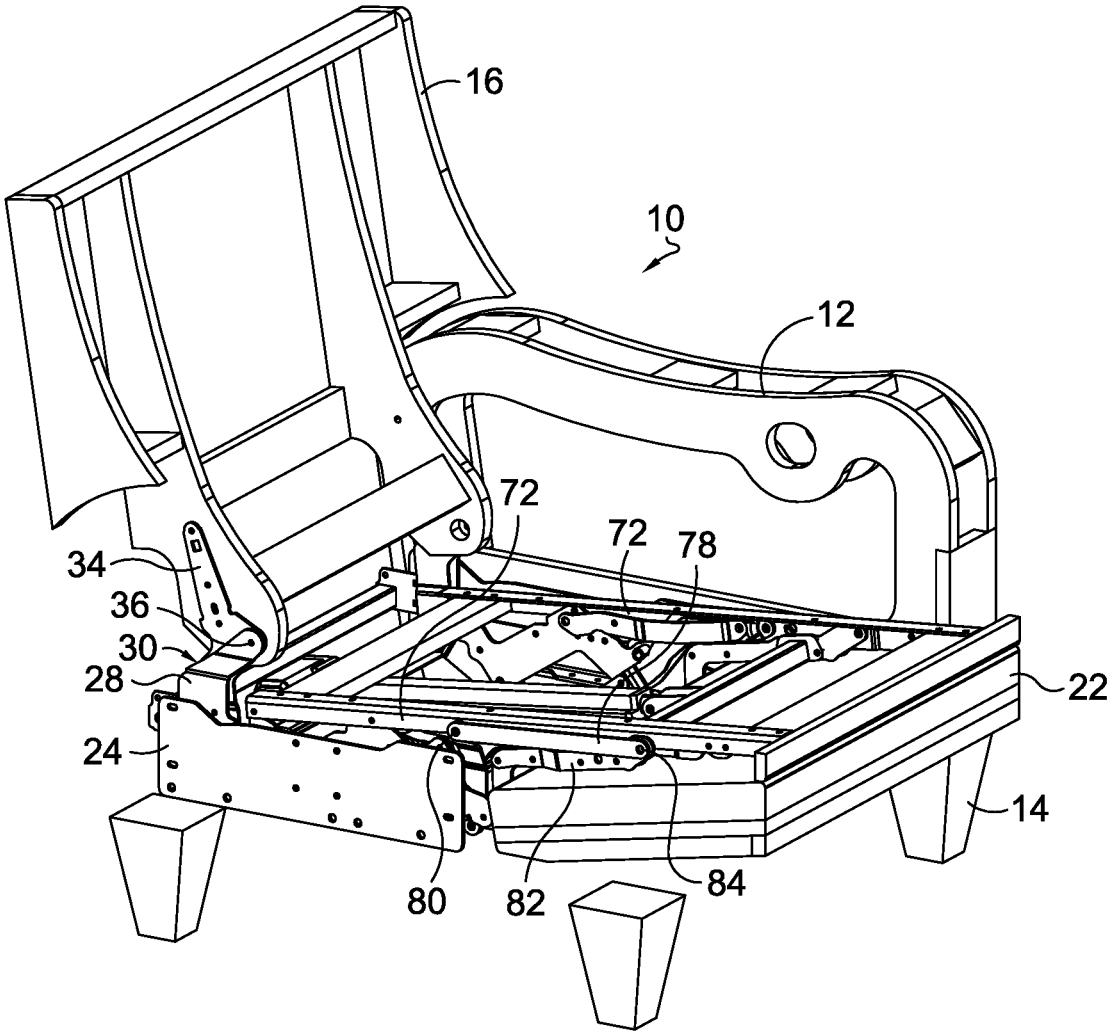
FIG. 5 is a view similar to FIG. 2, but shown with the wooden arm frame hidden.
Figure 6:
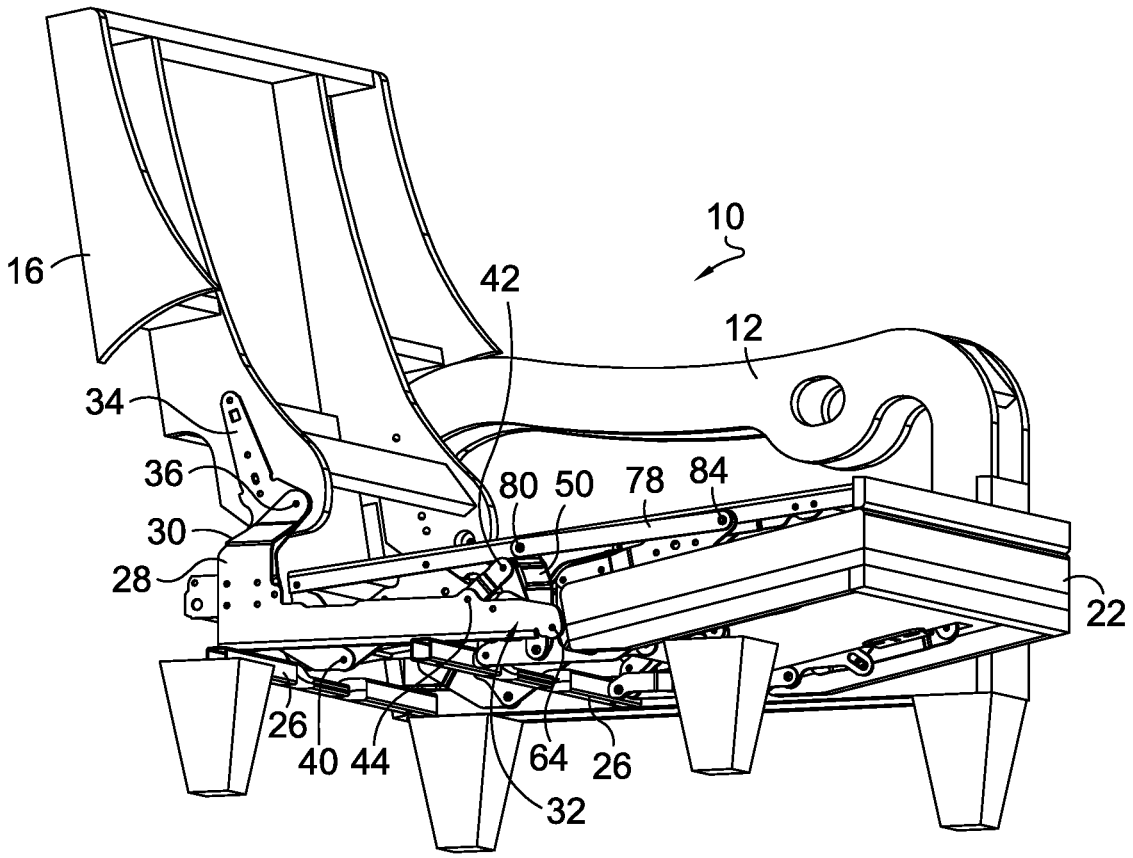
FIG. 6 is a view similar to FIG. 5, but shown with the chassis plate also hidden.

As shown in FIG. 5, the mechanism 18 is carried between the arms 12 via a chassis plate 24. Each arm 12 thus has a corresponding chassis plate 24 fixedly coupled thereto. FIG. 6 shows a view with one of the chassis plates 24 hidden from view. As seen in FIG. 6, the chassis plates 24 are coupled to one another via a pair of rigid cross-tubes 26. In some aspects, each cross-tube 26 has a lower-profile central section that provides clearance for a motor, as further described below. Each cross-tube 26 supports a base plate 28, with a flange of the base plate 28 being rigidly coupled (such as by bolting) to the cross-tubes 26.

Figure 7:
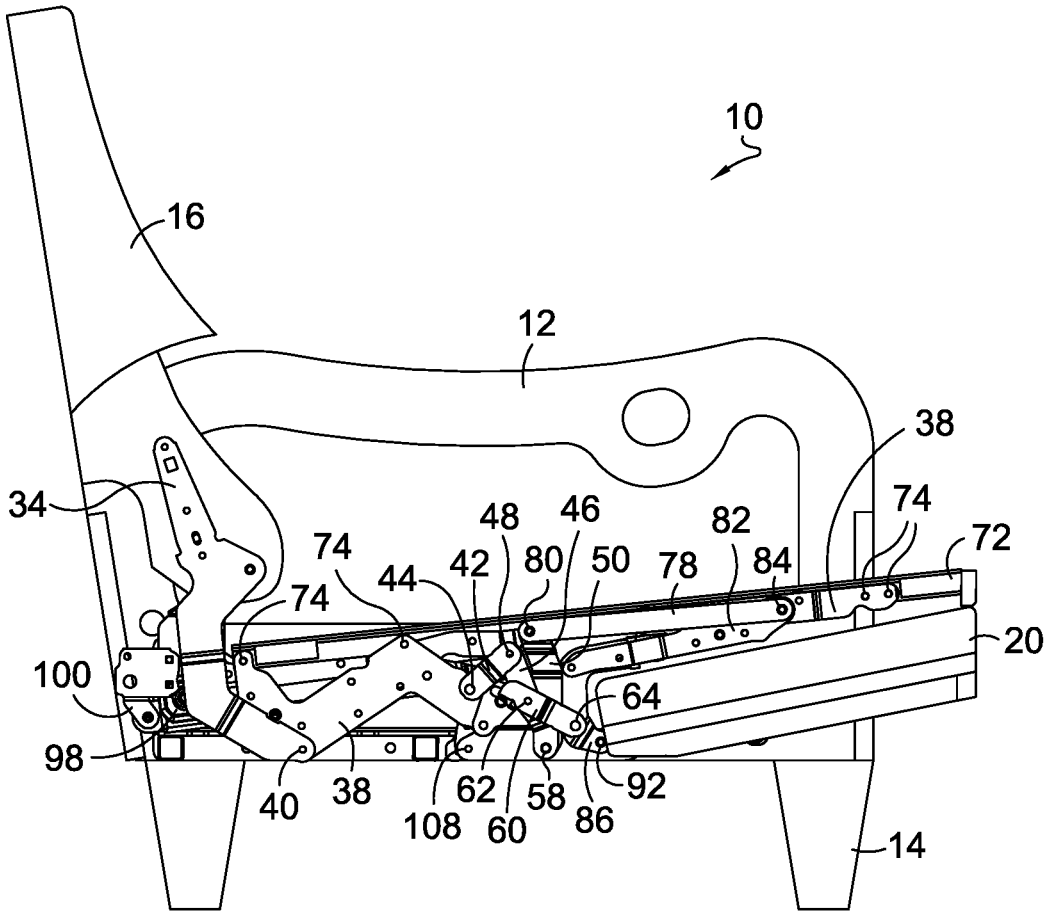
FIG. 7 is a side view similar to FIG. 6, but shown with the base plate also hidden.
Figure 7A:
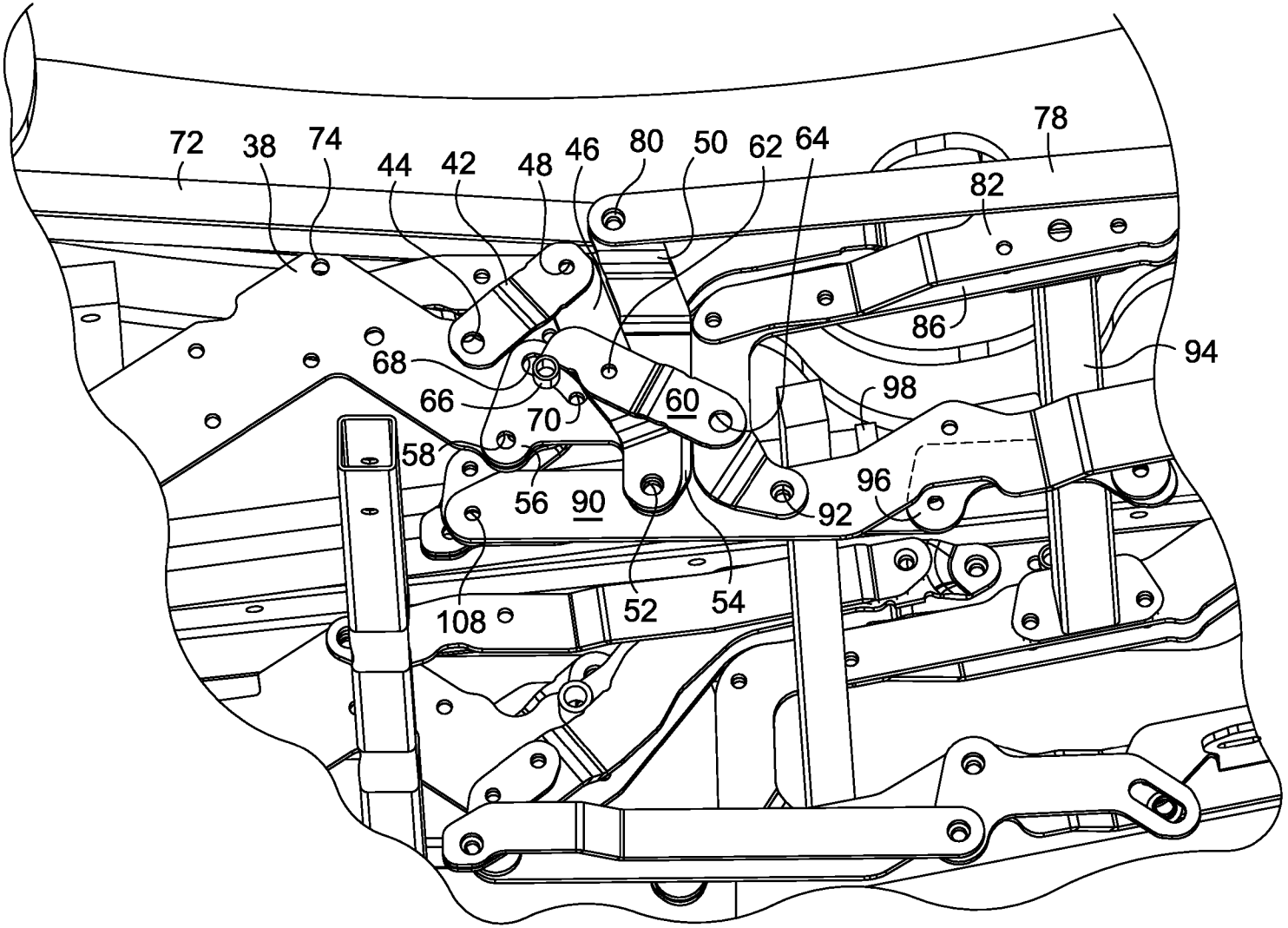
FIG. 7A is an enlarged perspective view of certain components of FIG. 7.
Figure 8:
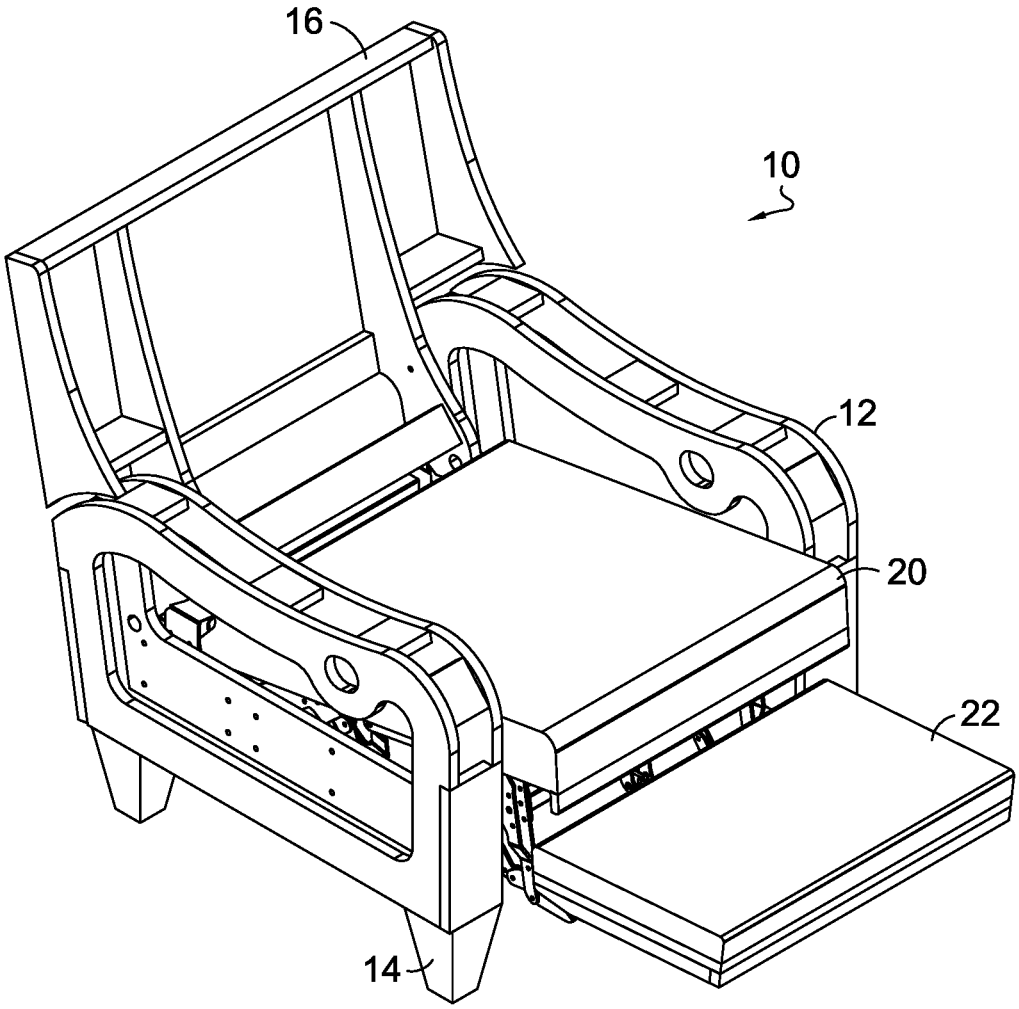
FIG. 8 is a perspective view of the chair and mechanism of FIG. 1, but in an intermediate laptop position, in accordance with aspects herein.

The base plates 28 carry the back 16 and seat 20 (and indirectly, the ottoman 22) through other links of the mechanism 18. As seen in FIGS. 5 and 6, each base plate 28 includes an inwardly extending back portion 30 that is pivotally coupled to a back bracket 34 at pivot point 36. The upper end of the back bracket 34 is rigidly coupled to the back 16. In some aspects, the connection between the back bracket 34 and the back 16 may allow a quick coupling (such as might be needed for ease of shipping and assembly), e.g. a knock-down (KD) bracket. The lower end of the back bracket 34 is pivotally coupled to a seat plate 38 at pivot point 40, as best seen in FIG. 7. Each base plate 28 further includes a front portion 32 that pivotally supports the seat plate 38 as well. More specifically, as best seen in FIGS. 6 and 7A, a control link 42 is pivotally coupled to the base plate 38 at pivot point 44. The opposite end of the control link 42 is pivotally coupled to a front travel link 46 at pivot point 48. The opposite end of the front travel link 46 is pivotally coupled to a lift link 50 at pivot point 52. The lift link 50 is best seen in FIGS. 3A and 3B. The lift link 50 has a front lower lobe 54 (which is pivotally coupled to the front travel link 46), and a rear lower lobe 56 which is pivotally coupled to the seat plate 38 at pivot point 58. Additionally, the front travel link 46 is pivotally coupled (between pivot points 48 and 52) to a pivot lift link 60 at pivot point 62. The pivot lift link 60 has a lower end that is pivotally coupled to the base plate 28 at pivot point 64. In some aspects, and as shown in FIG. 7A, the base plate 28 has a stop 66 that interacts with a portion of the pivot lift link 60 that extends beyond pivot point 62, when the chair is in the closed position. As best seen in FIGS. 3B and 7A, the lift link 50 also has a curved slot 68 formed therein that interacts with a pin 70 extending from the seat plate 38. The slot 68 on the lift link 50 acts as a stop and the rotation of the lift link 50 increases the angle (or pitch) of the seat 20 as the ottoman opens, to achieve a more comfortable position for the seat 20 in the TV and reclined positions. The back of the seat plate 38 is thus carried by the back bracket 34, while the more forward portion of the seat plate 38 is carried by the combined linkage of the control link 42, the front travel link 46, the lift link 50 and the pivot lift link 60. As best seen in FIG. 7, the seat plate 38 is fixedly coupled to a seat angle 72 (such as at rivet locations labeled 74 in FIG. 7). The seat angle 72 is used to support the seat 20. Therefore, as the seat plate 38 moves, so does the seat 20. The seat plate 38 (and/or the seat angle 72) provide a mounting rail for an ottoman linkage, as further described below.

Figure 3:
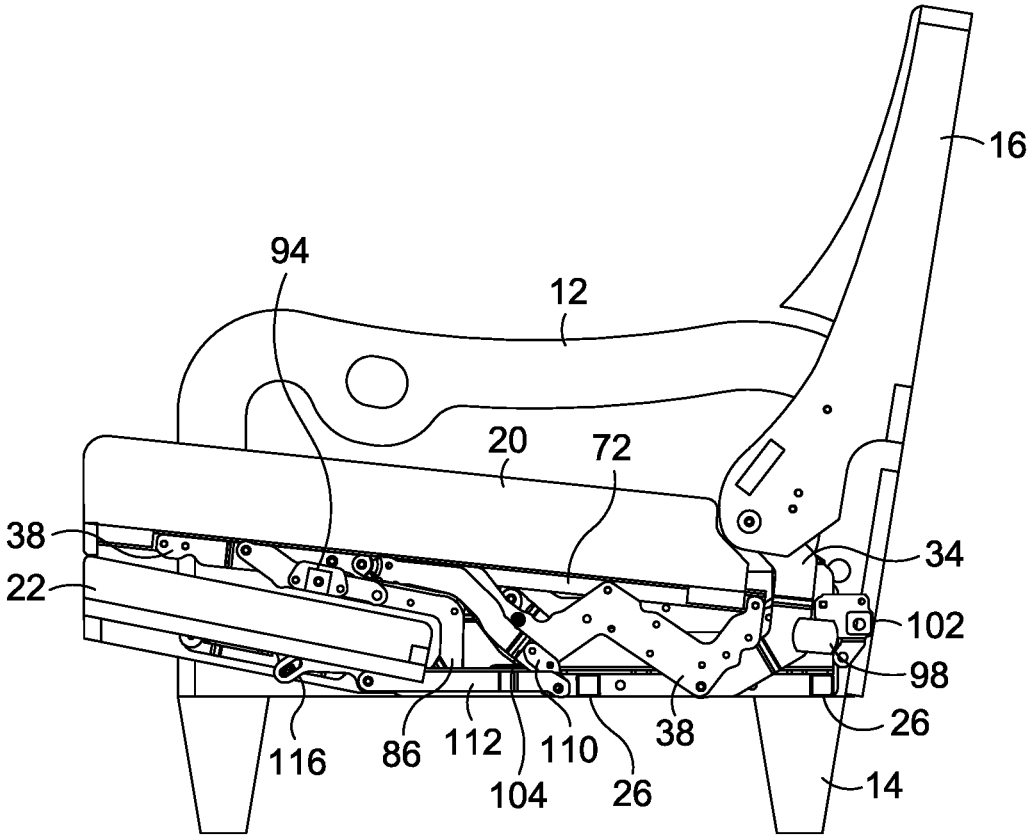
FIG. 3 illustrates a cross-sectional, side view of the chair of FIG. 1, shown with the chair facing in the opposite direction, in accordance with aspects herein.
Figure 3A:
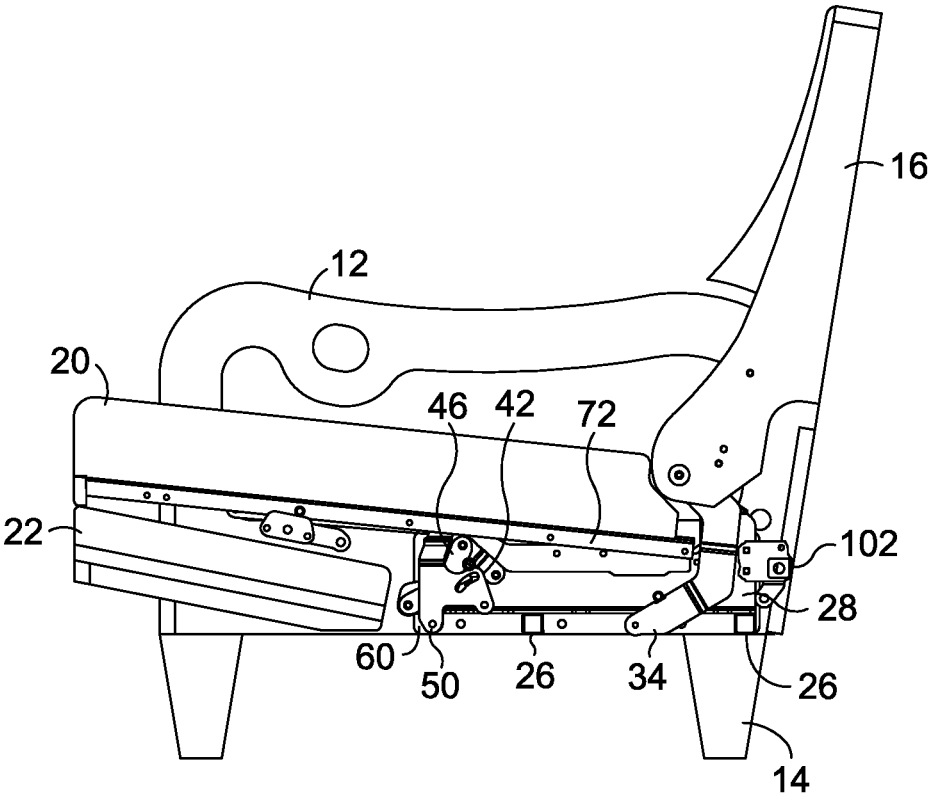
FIG. 3A is a cross-sectional view, similar to FIG. 3, but sectioned differently.
Figure 3B:
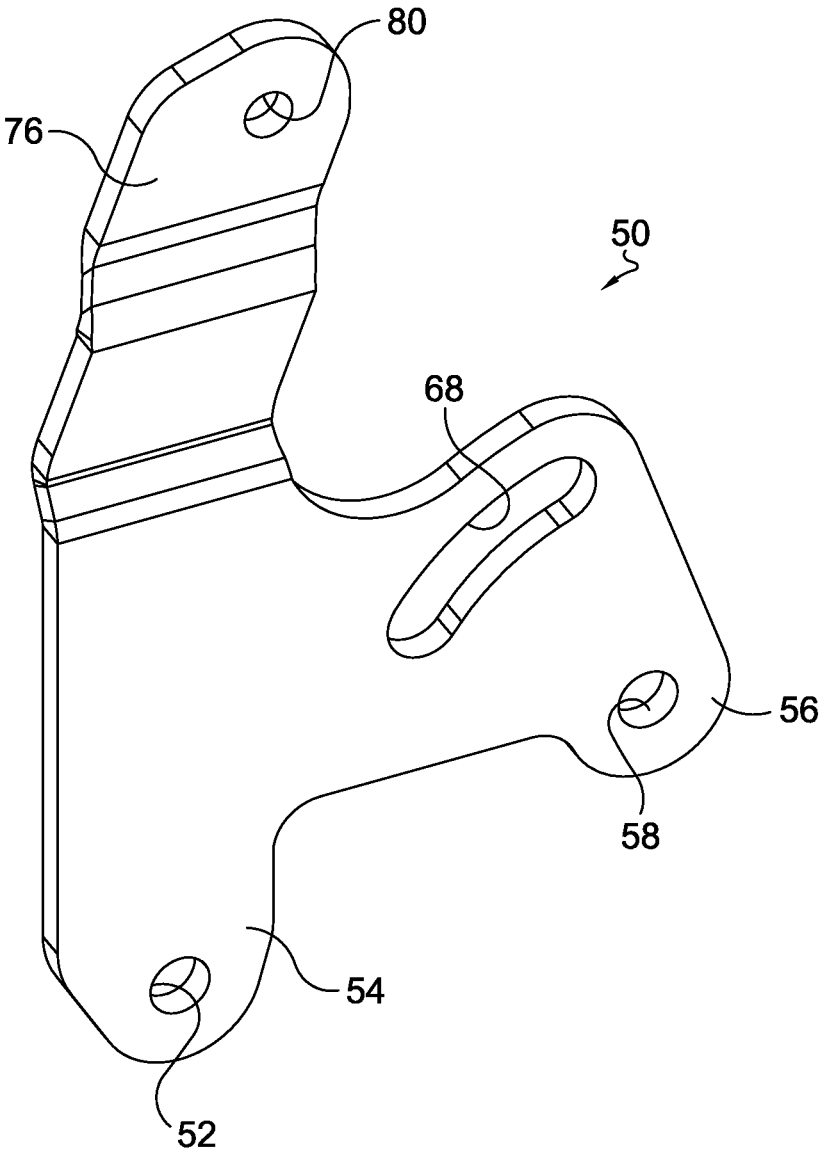
FIG. 3B is a perspective view of the lift link in the position of FIG. 3, and in isolation.
Figure 11:
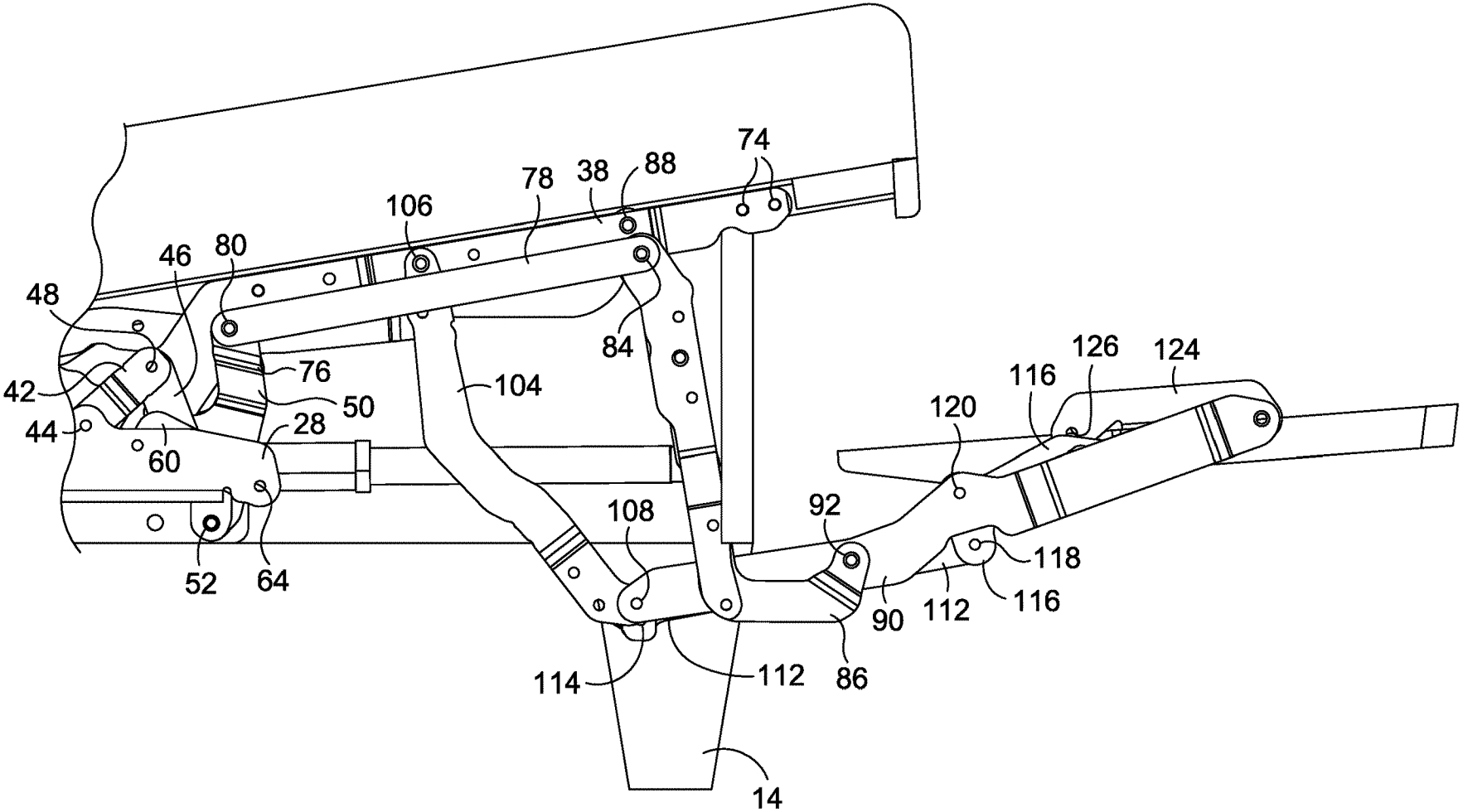
FIG. 11 is an enlarged, partial side view of portions of FIG. 10, but in showing the seat angle and the seat plate in transparent view, in accordance with aspects herein.

As best seen in FIGS. 3 and 11, the lift link 50 also has an upper lobe 76 that is pivotally coupled to a lift control link 78 at pivot point 80. As the chair 10 moves from the laptop position to the TV position, the lift control link 78 controls a lifting motion to initiate a seat pitch change, through the linkage of the control link 42, the pivot lift link 60, the front travel link 46 and the lift link 50. Once at the TV position, the slot 68 in the lift link 50 limits further travel, and the recline linkage of the control link 42, the pivot lift link 60, the lift link 50 and the front travel link 46 further lifts the seat 20 and moves the seat 20 forward (relative to the arms 12).

Figure 4A:
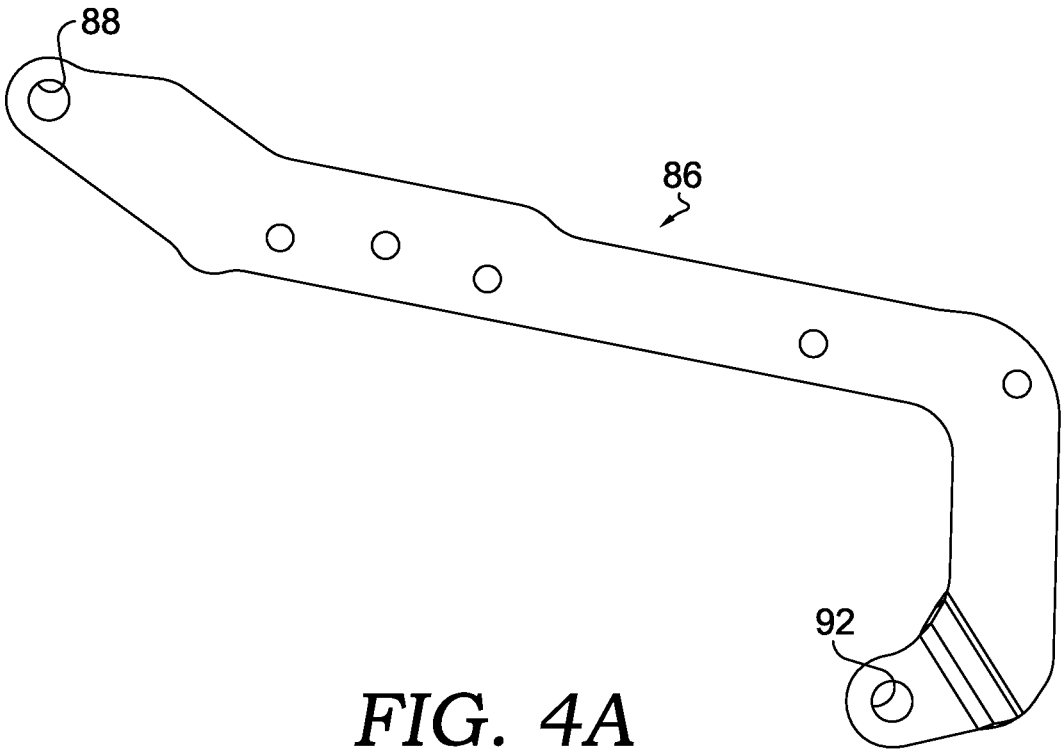
FIG. 4A is a view of the front ottoman link in the position of FIG. 4, and in isolation.
Figure 12:
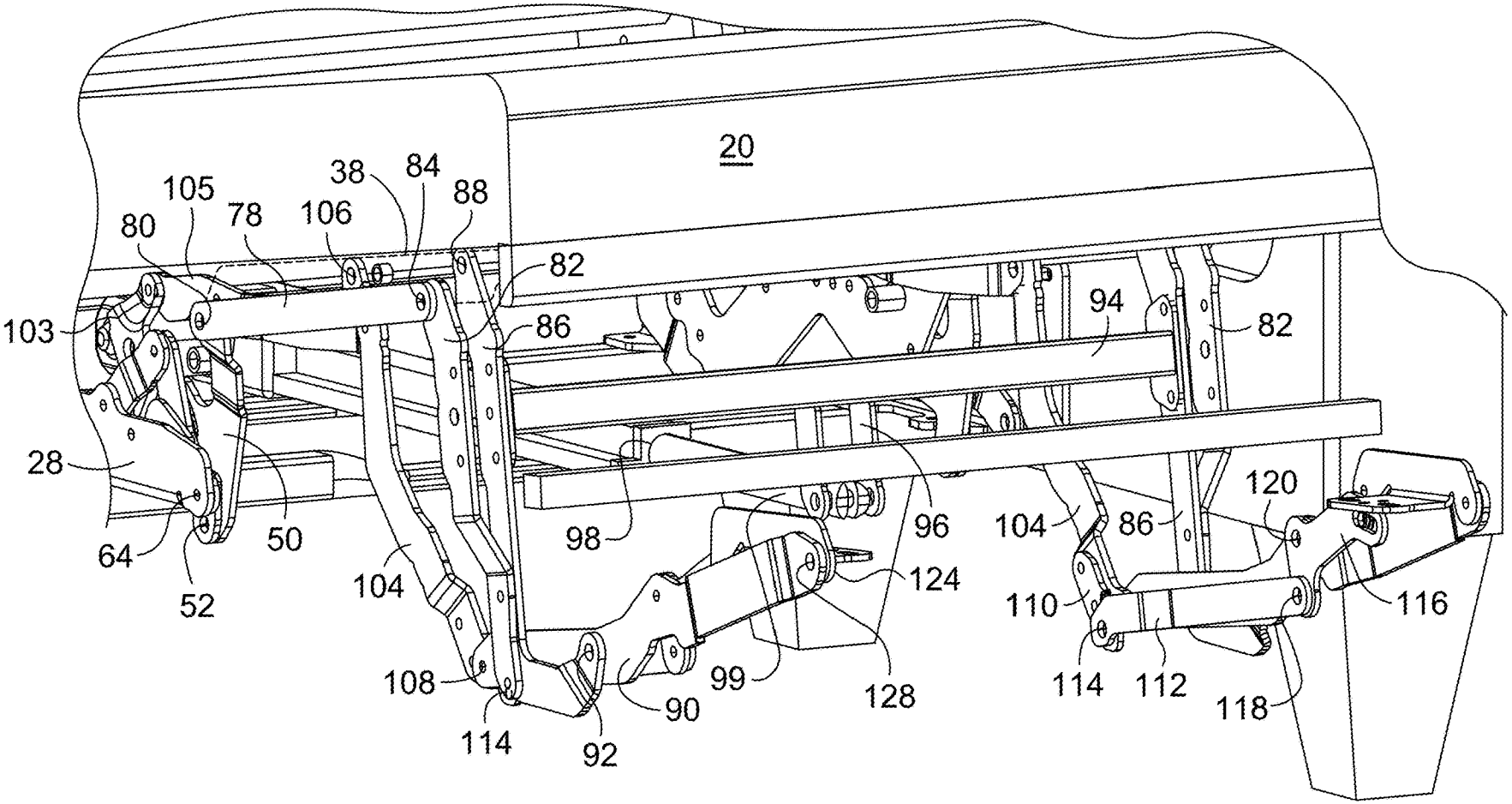
FIG. 12 a partial perspective view of portions of FIG. 11.
Figure 13:
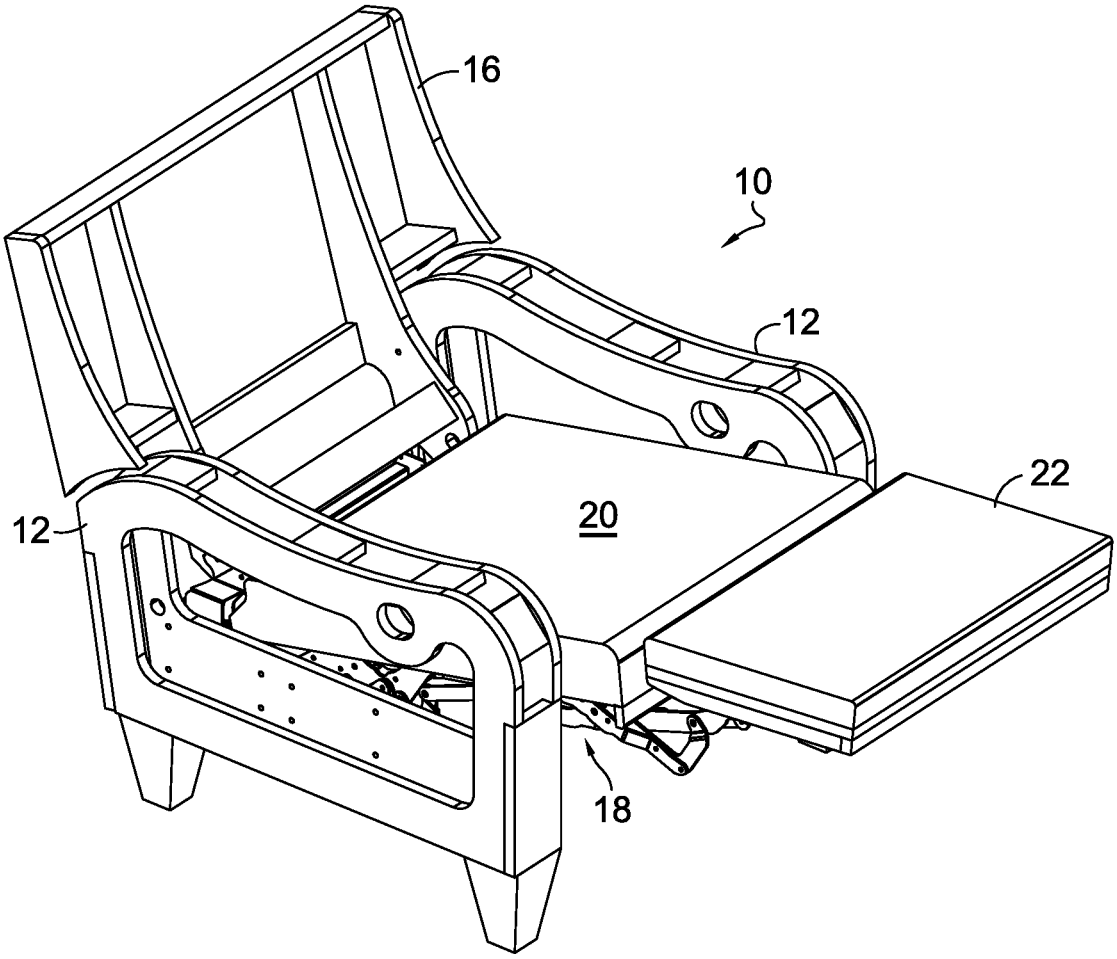
FIG. 13 is a perspective view of the chair and mechanism of FIG. 1, but in an extended or TV position, in accordance with aspects herein.
Figure 14:
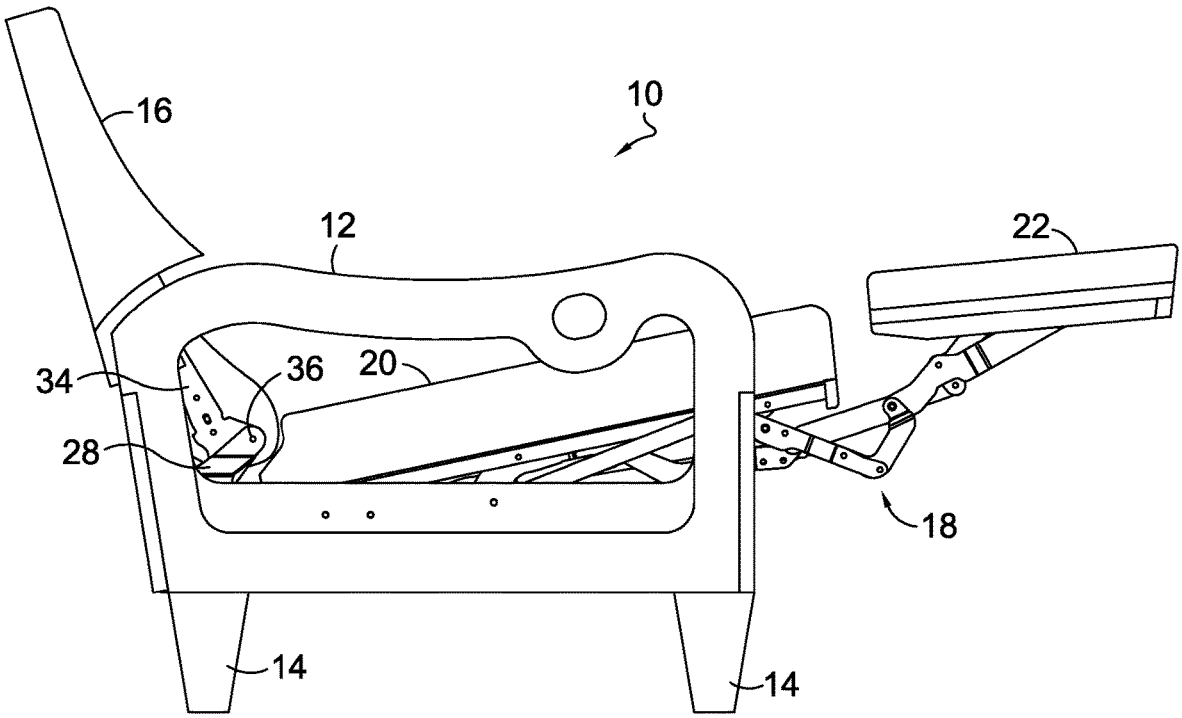
FIG. 14 is a side view of FIG. 13, in accordance with aspects herein.
Figure 15:
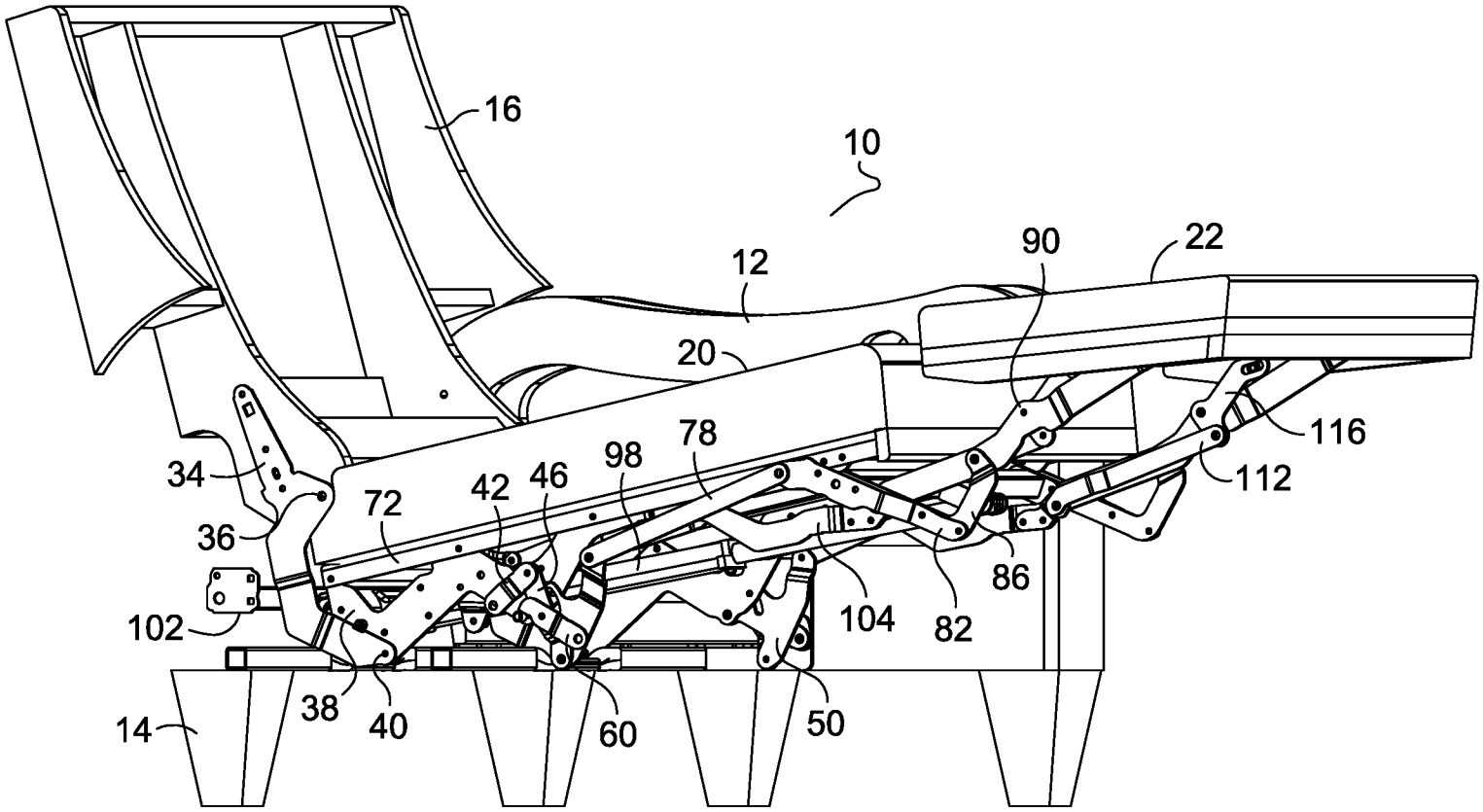
FIG. 15 is a view similar to FIG. 13, but with certain portions of the arm, the chassis plate and the base plate hidden from view, and with the seat angle shown transparent.
Figure 16:
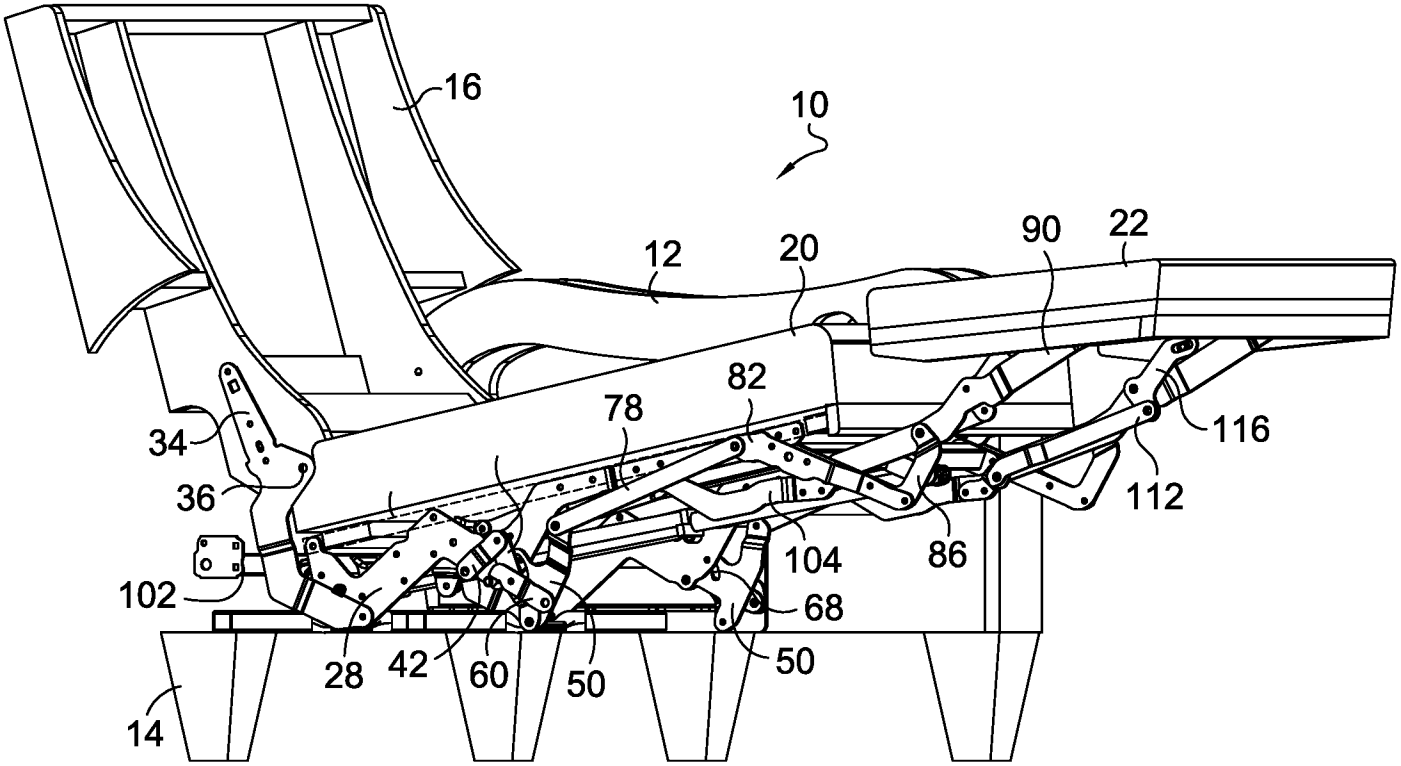
FIG. 16 is a wire-frame view of FIG. 15.
Figure 17:
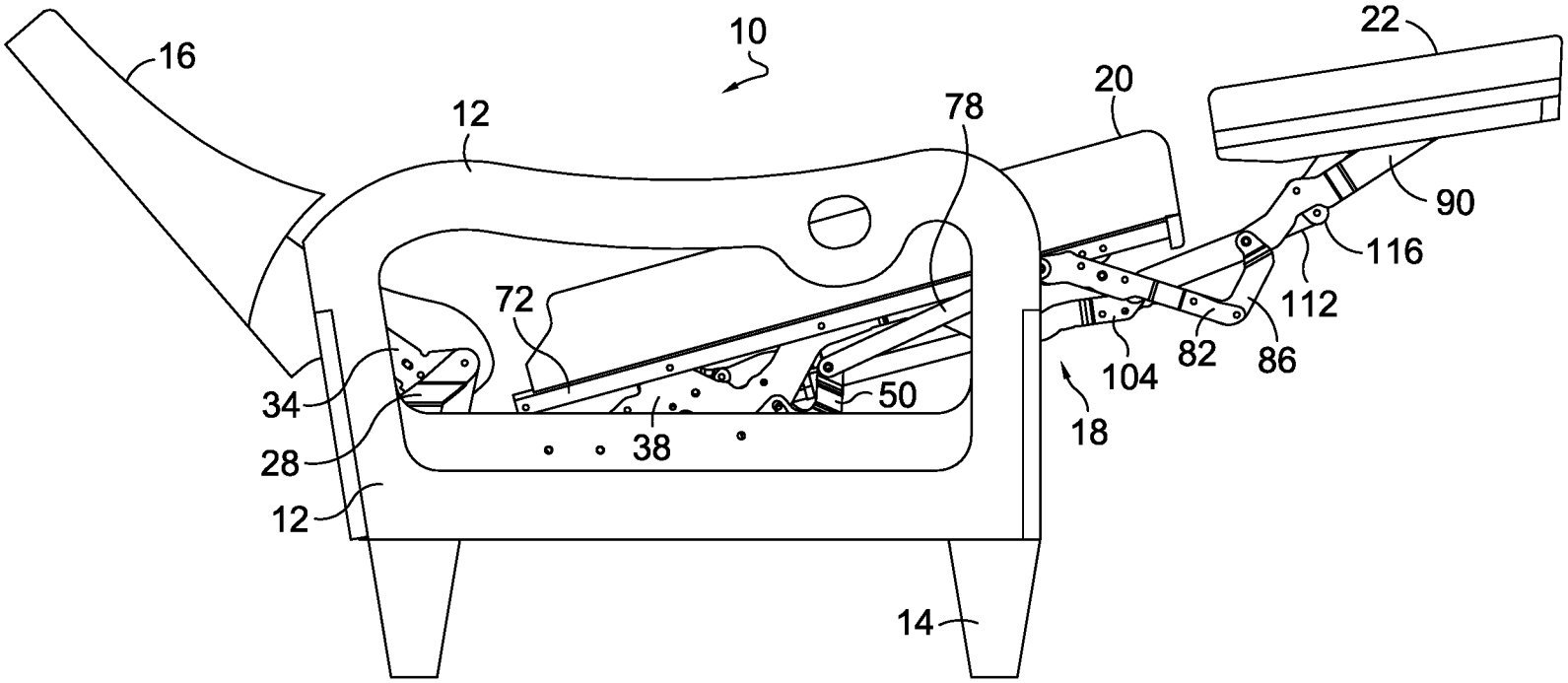
FIG. 17 is a side view of the chair and mechanism of FIG. 1, but in fully reclined position, in accordance with aspects herein.
Figure 21:
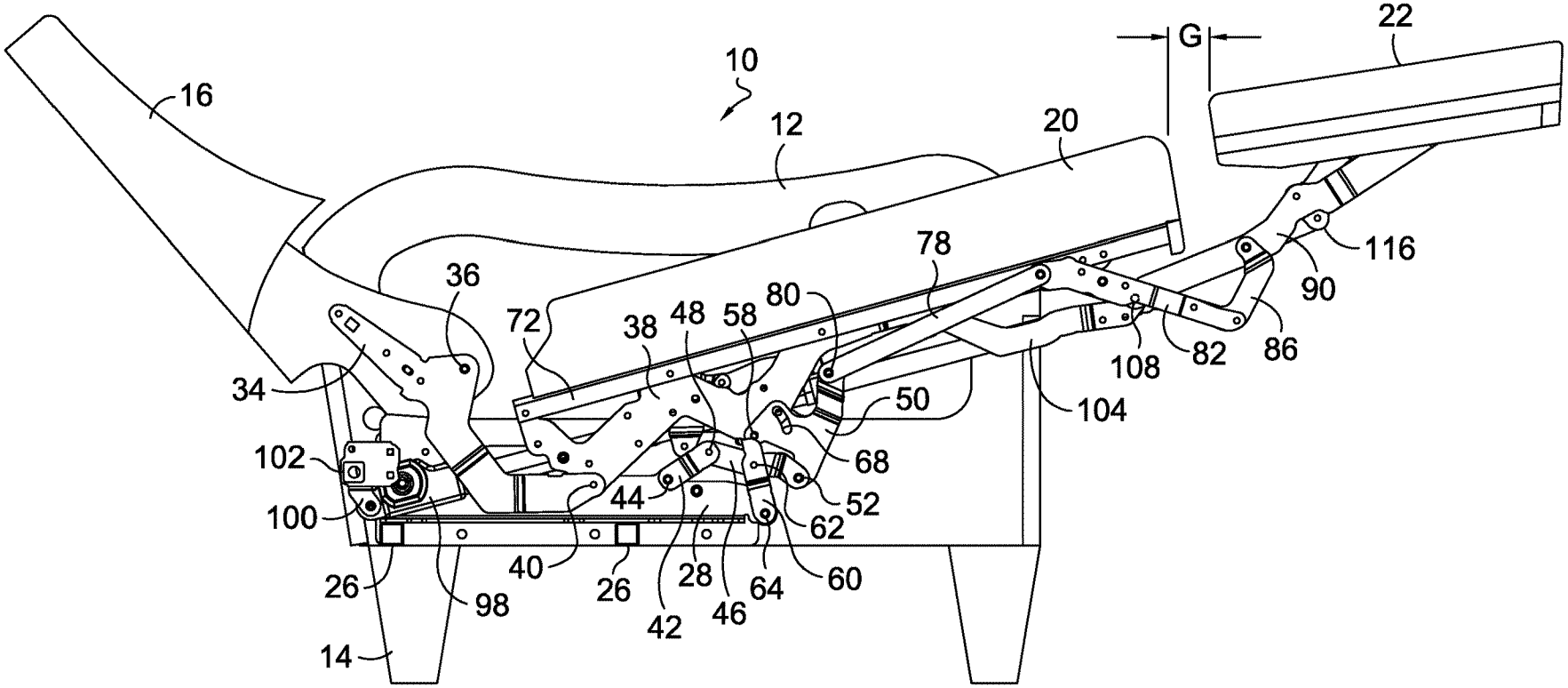
FIG. 21 is a side view of FIG. 20.

As seen in FIG. 21, the lift control link 78 extends forwardly, and is coupled at its forward end to a front ottoman extension bracket 82 at pivot point 84. The front ottoman extension bracket 82 extends away from pivot point 84, and is rigidly coupled at its opposite end to a front ottoman link 86. The overall shape of the front ottoman link 86 is best seen in FIG. 4A. The front ottoman link 86 has an upper end that is pivotally coupled to the inner edge of the seat plate 38 at pivot point 88, as seen in FIGS. 11 and 12. The front ottoman extension bracket 82 and the front ottoman link 86 form a combined link with a forked upper end (as best seen in FIG. 12). This combined link effectively allows for pivot points 84 and 88 to be very near one another (such as might not be possible if the front ottoman link 86 and the front ottoman extension bracket 82 were formed as one link without the forked end). This combined link the (front ottoman extension bracket 82 and the front ottoman link 86) also allows a coupling on either side of the seat plate 38 or seat angle 72. As best seen in FIG. 12, pivot point 84 is outward of the seat plate 38 and pivot point 88 is on the inside of the seat plate 38. The combined link allows such a coupling without having to notch or otherwise remove a portion of the seat angle 72 or the seat plate 38. The hook end, e.g., the forward end, of the front ottoman link 86 is pivotally coupled to a main ottoman link 90 at pivot point 92. As best seen in FIG. 4, the shape of the front ottoman link 86 allows the hook end of the front ottoman link 86 to be routed around the ottoman 22 in the closed position. In some aspects, the pivot point 92, in the closed position, is behind the back of the ottoman 22, and in some aspects, the pivot point 92 is also below (or adjacent) the bottom of the ottoman 22, in the closed position. The shape of the front ottoman link 86, in part, allows the ottoman 22 to fit below the seat 20 in the closed position, and allows the links in the mechanism 18 to fit above the bottom of the arms 12 (and above the top of the legs 14). The shape of the front ottoman link 86 also moves the ottoman 22, in the TV and reclined positions, to a position relative to the seat 20 such that a mid-ottoman is not needed (in other words, the gap "G" in FIG. 21 is less than a distance requiring a mid-ottoman, and in some aspects the distance G is less than five inches).

Figure 2:
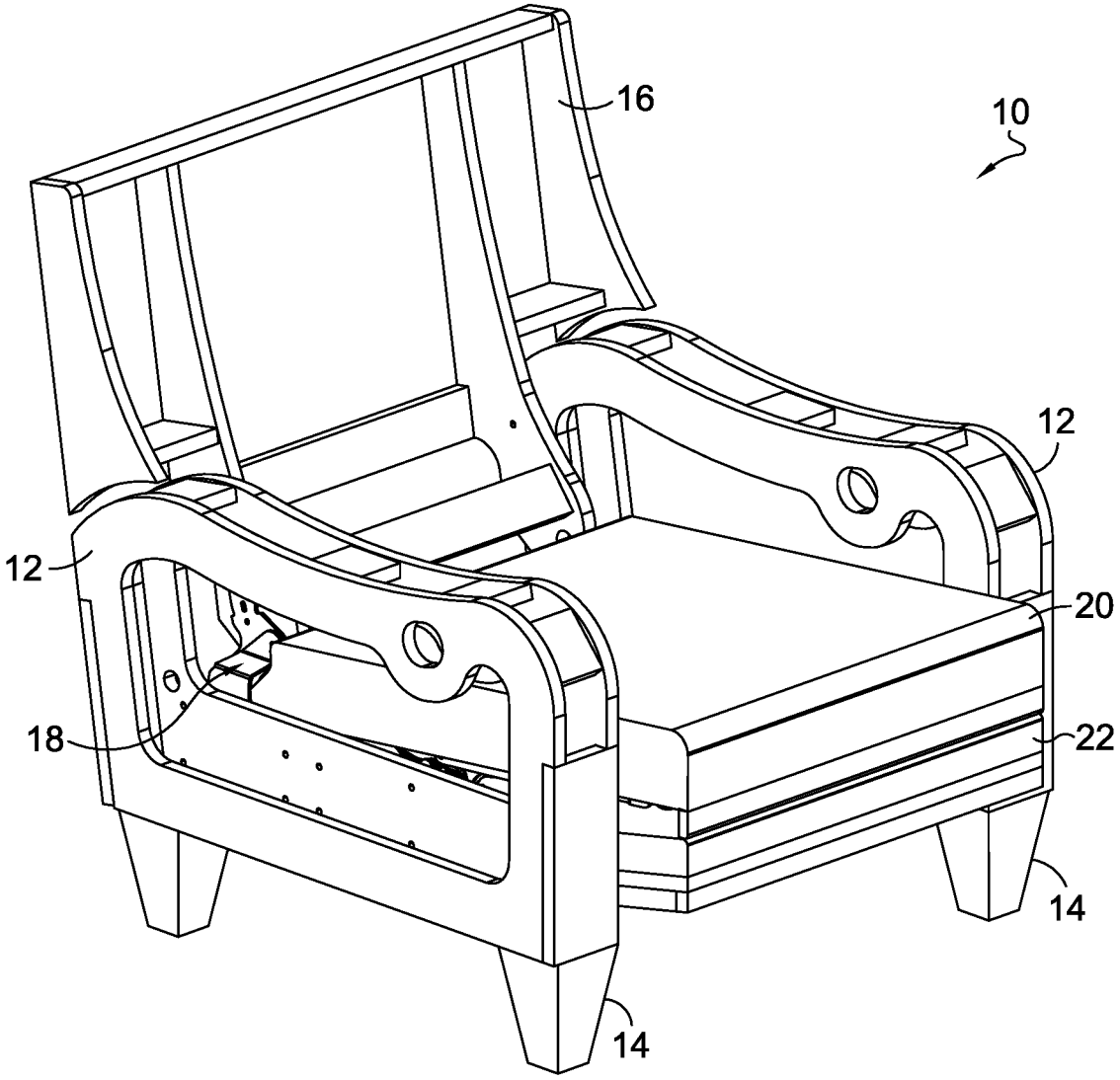
FIG. 2 illustrates a perspective view of the chair of FIG. 1, in accordance with aspects herein.
Figure 2A:
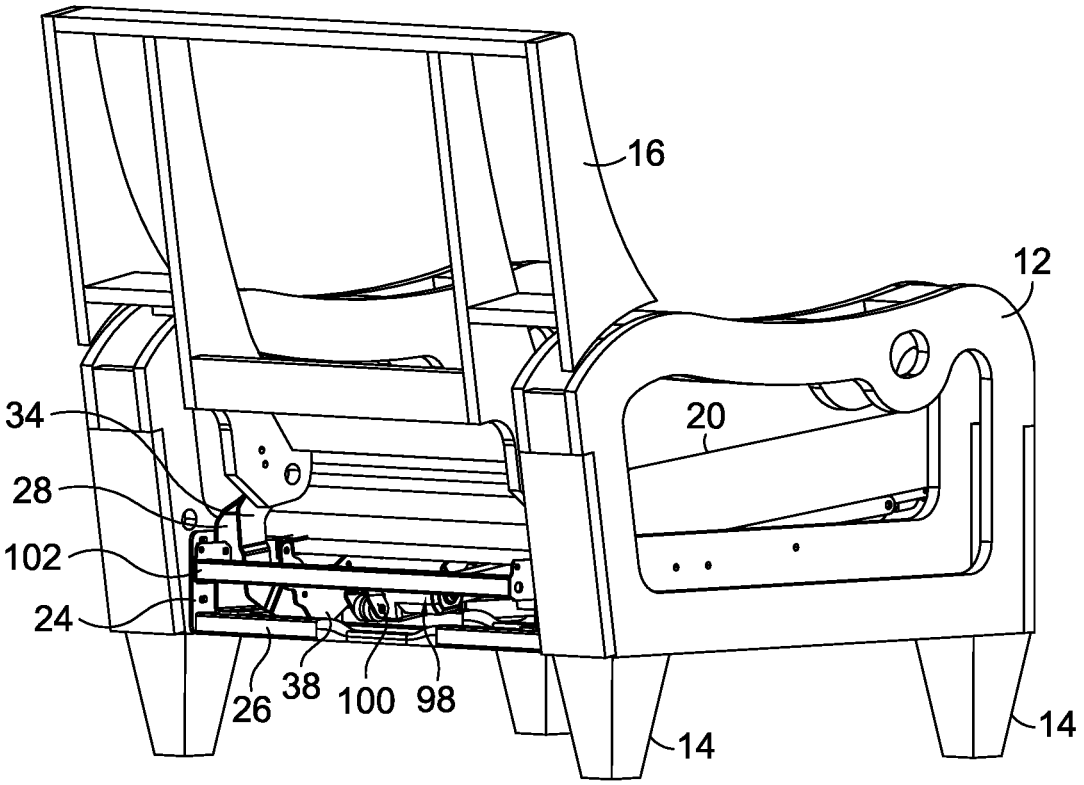
FIG. 2A illustrates a view similar to FIG. 2 but from a different perspective.
Figure 10:
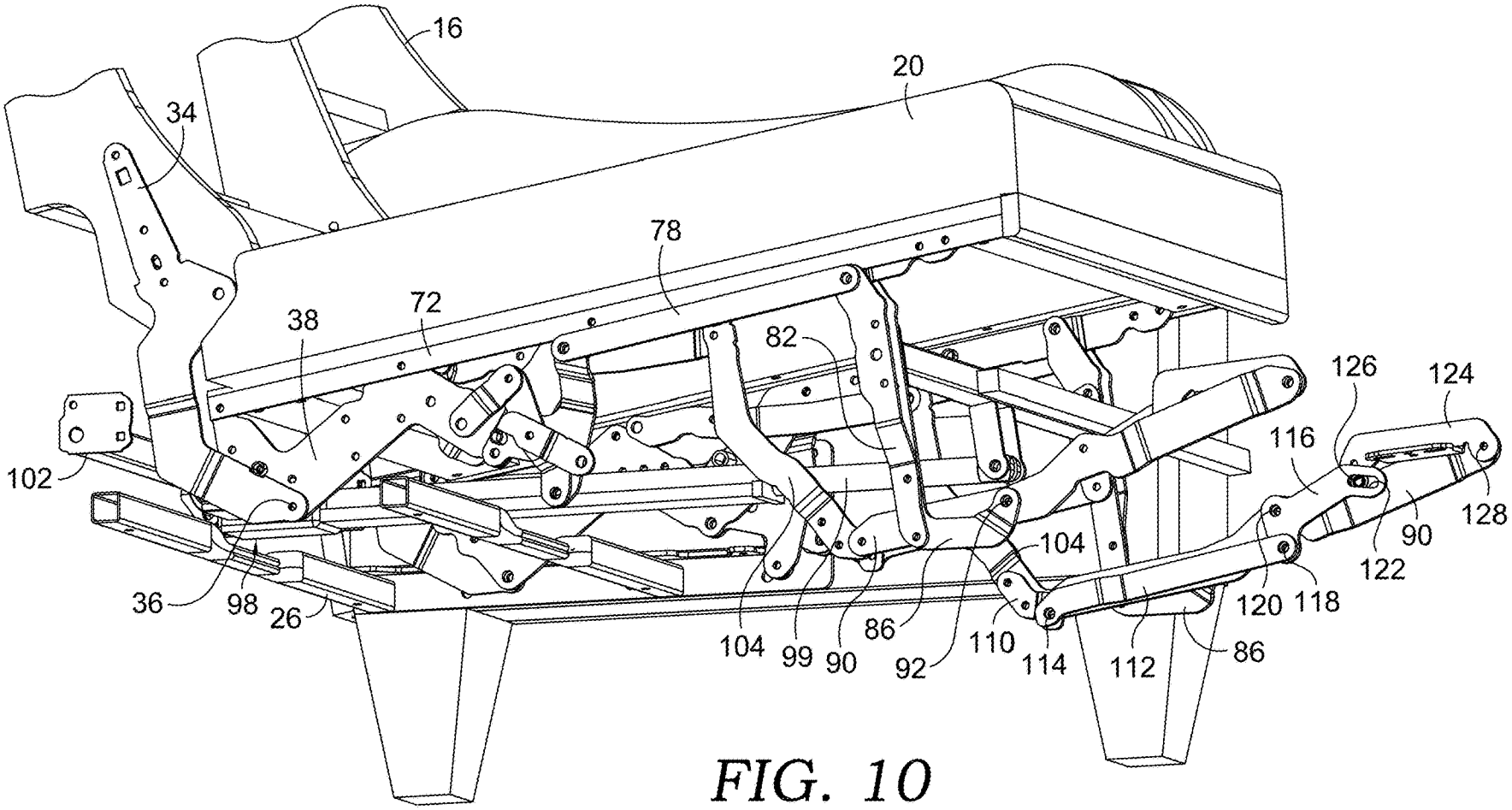
FIG. 10 is a partial, perspective view similar to FIG. 8, but with portions of the arm, legs, chassis plate and base plate all hidden, in accordance with aspects herein.

As seen in FIG. 12, the front ottoman links 86 are coupled to one another via a front motor tube 94 that is rigidly coupled on each end to a respective front ottoman link 86. The front motor tube 94 supports a bracket 96 that is rigidly coupled to the front motor tube 94. One end of a motor 98 (such as a linear actuator) is pivotally coupled to the bracket 96. The motor 98 has an extendable shaft 99, as seen in FIG. 10, that is coupled to the bracket 96. As seen in FIG. 2A, the opposite end of the motor 98 is pivotally coupled, through a bracket 100, to a rear motor tube 102. The rear motor tube 102 spans between the base plates 28 and is fixedly coupled to each base plate 28.

Figure 18:
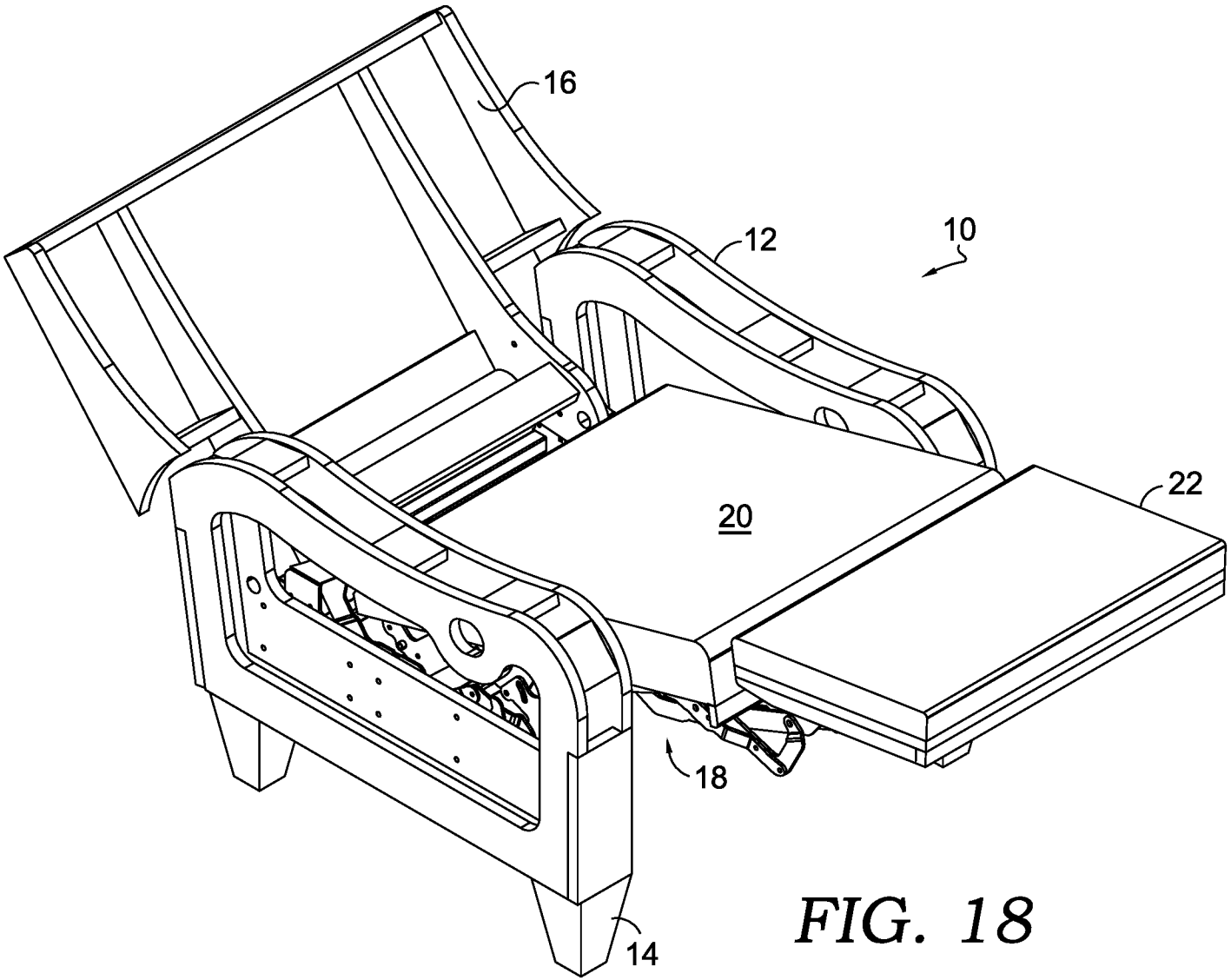
FIG. 18 is a perspective view of the chair and mechanism in the position of FIG. 17.
Figure 18A:
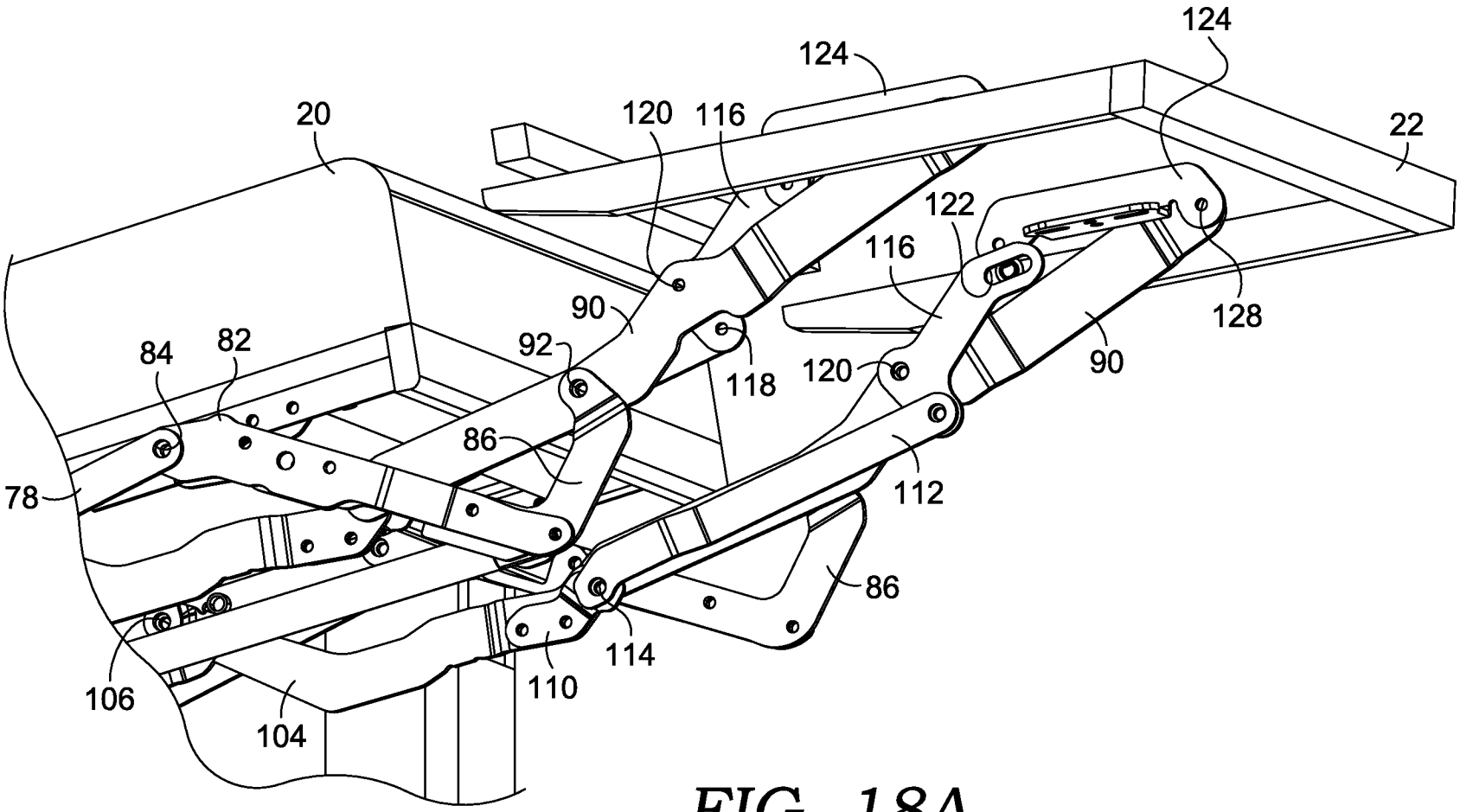
FIG. 18A is an enlarged perspective view of portions of the chair in the position of FIG. 18, and also shown with portions of the ottoman removed.
Figure 19:
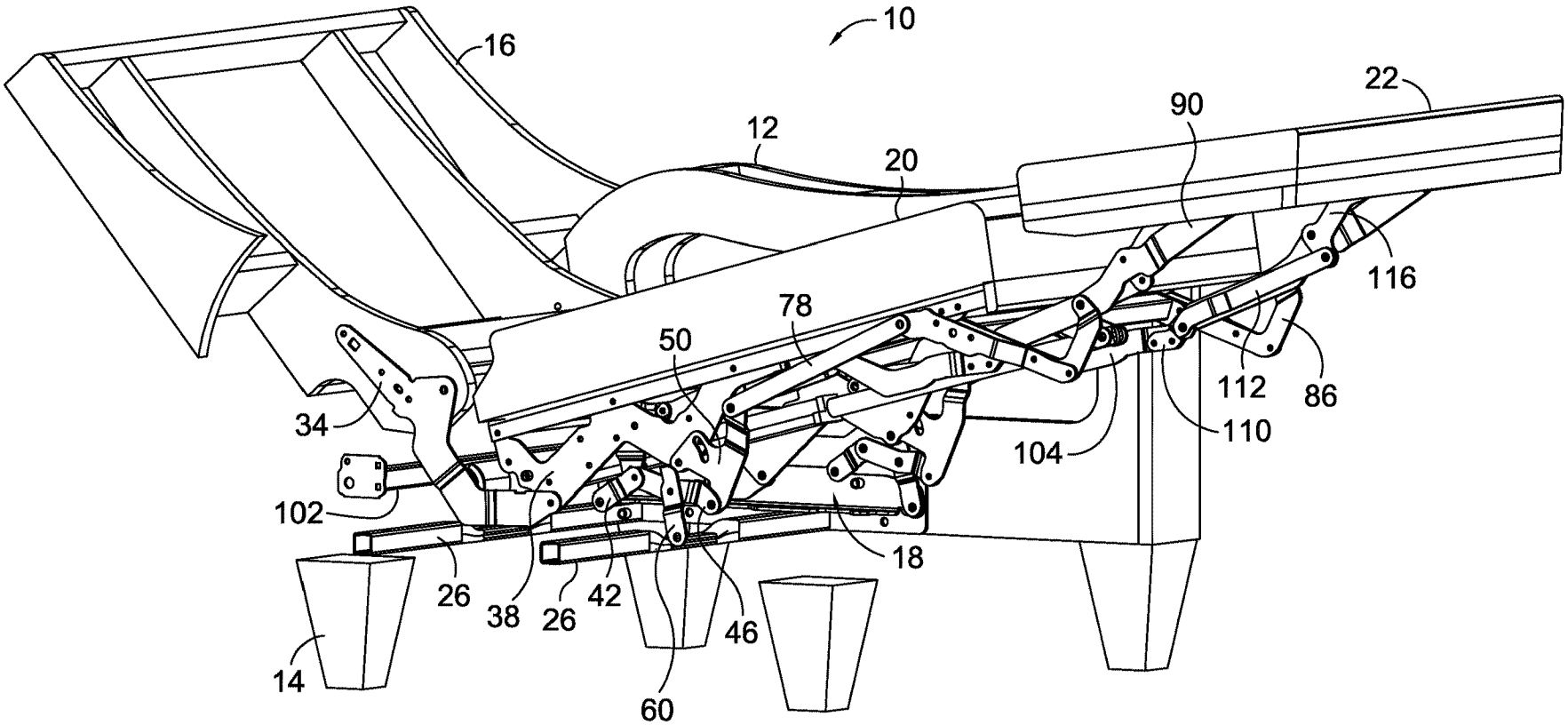
FIG. 19 is a view similar to FIG. 18, but shown with certain portions of the arm, the chassis plate and the base plate hidden from view, and with the seat angle shown transparent.
Figure 20:
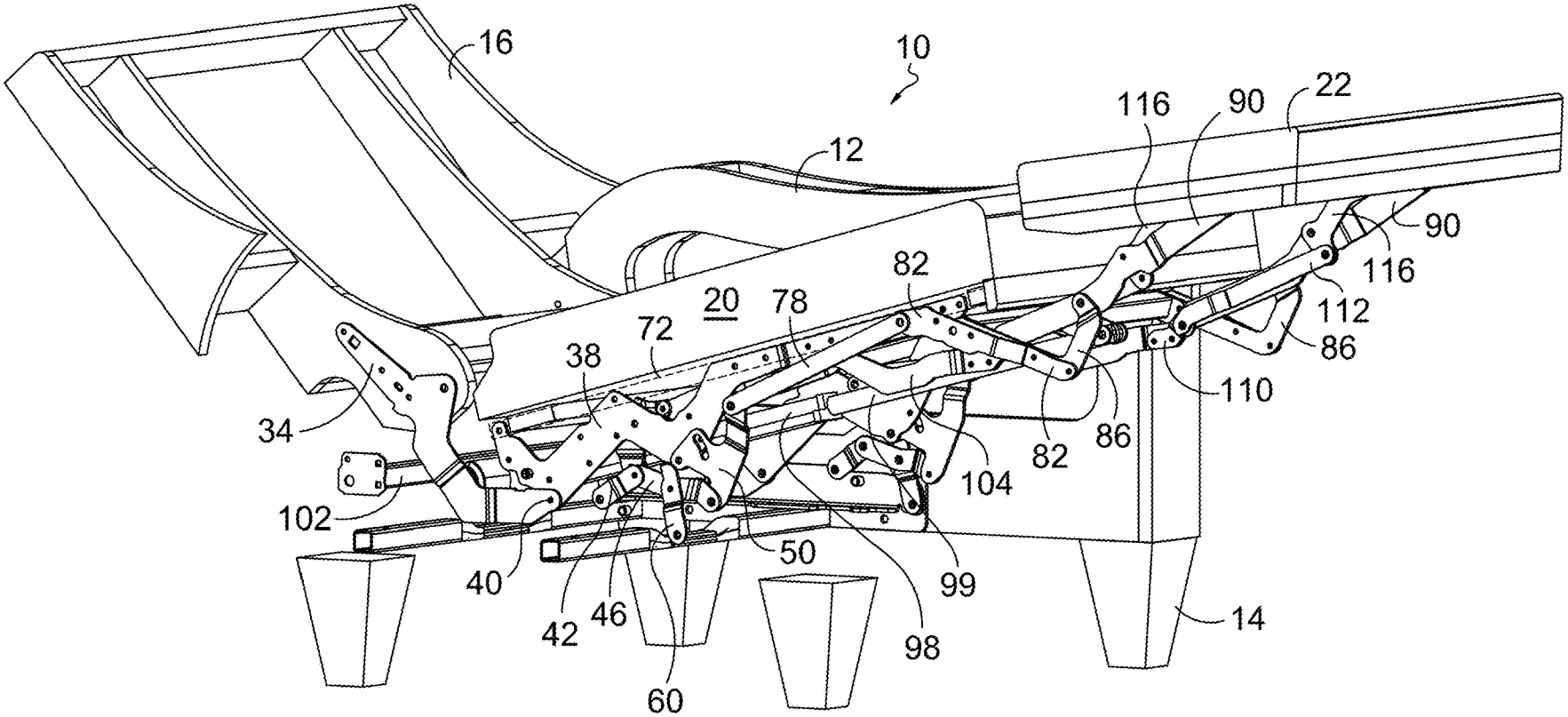
FIG. 20 is a wire-frame view of FIG. 19.
Figure 22:
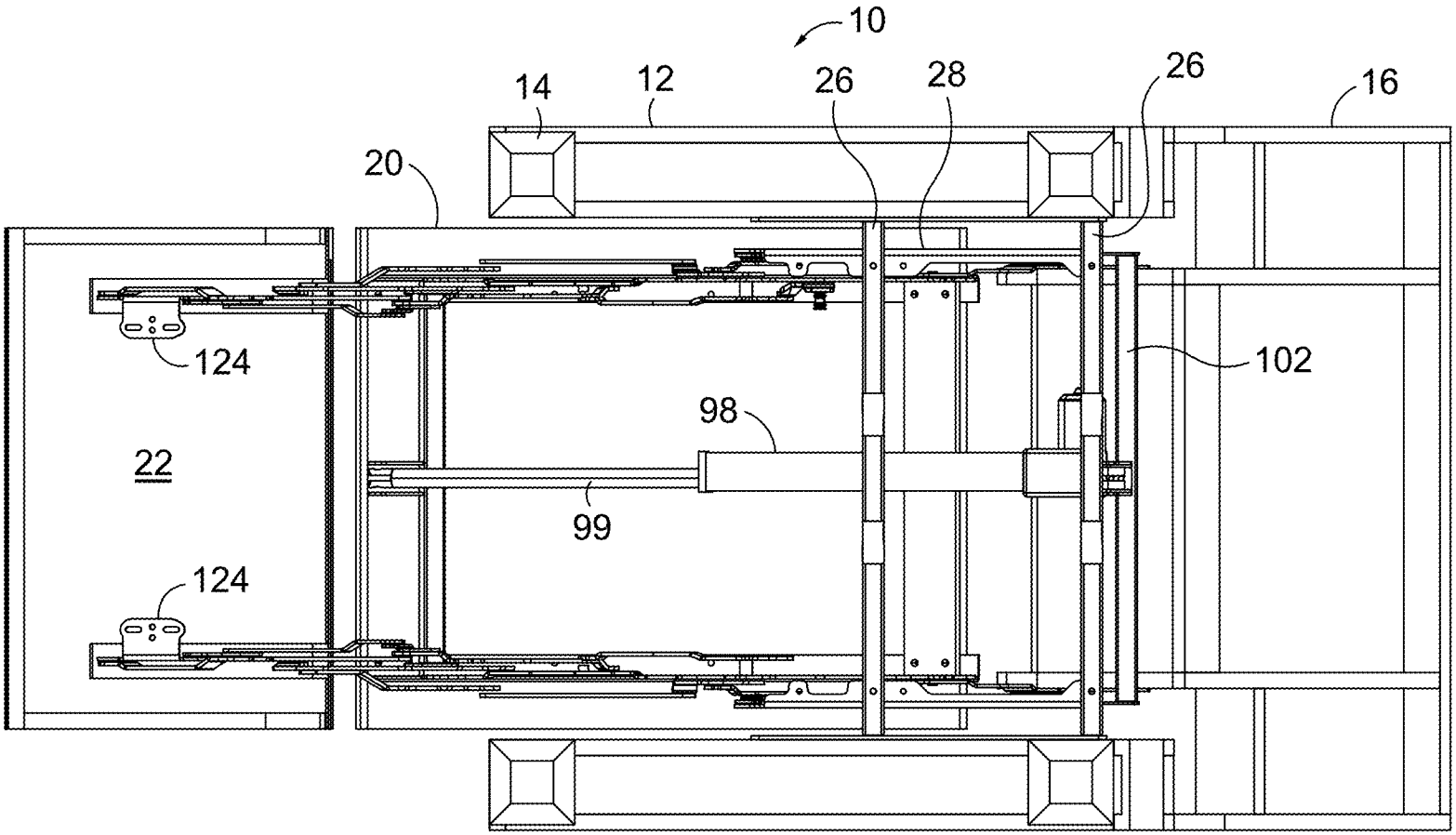
FIG. 22 is a bottom plan view of the chair and mechanism in the reclined position of FIGS. 17-21.

Returning to FIGS. 11 and 12, a rear ottoman link 104 is pivotally coupled to the seat plate 38 at pivot point 106. The rear ottoman link 104 extends away from pivot point 106, and is pivotally coupled at the end opposite pivot point 106 to the main ottoman link 90 at pivot point 108. As best seen in FIG. 12, a rear ottoman bracket 110 is fixedly coupled to the lower end of the rear ottoman link 104, on the inner side of the rear ottoman link 104. The rear ottoman bracket 110 has a lower end that is pivotally coupled to an ottoman pitch control link 112 at pivot point 114. As best seen in FIG. 11, the ottoman bracket 110 allows the effective pivotal coupling of the rear ottoman link 104 to both the main ottoman control link 90 (at pivot point 108) and the ottoman pitch control link 112 (through ottoman bracket 110 at pivot point 114), even though pivot point 108 is close in proximity to pivot point 114. As best seen in FIGS. 10 and 18A, the end of the ottoman pitch control link 112 opposite pivot point 114 is pivotally coupled to an ottoman bellcrank 116 at pivot point 118. Near pivot point 118, the ottoman bell crank 116 is also pivotally coupled to the main ottoman link 90 at pivot point 120. As best seen in FIG. 18A, the ottoman bellcrank 116 includes a slot 122. Through the slot 122, the ottoman bellcrank 116 is coupled to a footrest bracket 124 at point 126, allowing the point 126 to move within the slot 122. The footrest bracket 124 may include a flange that is used to couple the ottoman 22 to the footrest bracket 124. The outer end of the footrest bracket 124 is pivotally coupled to the outer end of the main ottoman link 90 at pivot point 128. It can be seen by comparing FIG. 18A and FIG. 21 that portions of the footrest bracket 124 extend into the ottoman 22. As seen in FIG. 22, a lower support board of the ottoman 22 may be slotted to accommodate the footrest bracket 124. Together, the ottoman pitch control link 112 and the ottoman bellcrank 116 control the pitch, e.g., the orientation, or angle, of the ottoman 22 as it moves from the closed position to the reclined position (and positions therebetween). In some aspects, the angle of the ottoman 22 with respect to the floor (such as the angle $\alpha$ in FIG. 9) is between 0-15 degrees in the laptop position, allowing a user to comfortably rest their feet on the ottoman 22. In some aspects, as shown in FIG. 12, a spring bellcrank 103 may be pivotally coupled to the seat plate 38. An upper end of the spring bellcrank 103 is pivotally coupled to a spring drive link 105. The end of the spring drive link 105 opposite the spring bellcrank is pivotally coupled to the rear ottoman link 104. A lower end of the spring bellcrank 103 may have an extension to hold a spring, and the opposite end of the spring can be coupled to the rear motor tube 102 (such as through a bracket attached to the rear motor tube 102). In some aspects, the spring, the spring bellcrank 103 and the spring drive link 105 assist in opening the ottoman 22 and help in preventing the back 16 from reclining out of sequence.

As shown in FIG. 22, the mechanism 18 allows for the ottoman 22 to extend the full width of the seat 20, for the entire length (from the back of the chair 10 towards the front of the chair 10) of the ottoman 22. This is achievable, in part, due to the shape of the front ottoman link 86 as the hook end of the front ottoman link 86 extends around the ottoman 22 in the closed position.

In the closed position, the mechanism 18 allows a clean front edge of the chair 10. Said another way, the "clean front edge" of the chair 10 is defined by the front face of the ottoman 22 being in line with, e.g., forming a plane with, the front face of the seat 20, as seen in FIG. 1. As the motor 98 extends, the motor 98 acts on the front ottoman links 86. The motor 98 can be stopped with the shaft 99 extended at any of an infinite number of positions, including the intermediate or laptop position of FIGS. 8-12, the TV position of FIGS. 13-16 and the reclined position of FIGS. 17-22. Because the mechanism 18 moves the ottoman 22 with the top face of the ottoman 22 generally facing upward for the entire motion, the positions of the ottoman 22 between the closed position and the TV position are usable, if desired. It has been found that an intermediate position, (such as that shown in FIGS. 8-12) with the top face of the ottoman 22 facing up, but with the top face of the ottoman 22 below the top of the seat 20, is comfortable when a user rests his or her feet on the ottoman 22 (the laptop position). The mechanism 18 allows this motion and this ottoman positioning, while also moving the ottoman 22 to the TV position and reclined position with the ottoman 22 moved high enough to be generally as high as the top of the seat 20. This height is achieved, in part, through the coupling of the main ottoman link 90 as it extends forwardly to the footrest bracket 124, such that pivot point 128 is moved away from the back of the ottoman 22 and toward the front of the ottoman 22. Additionally, the pivot points of the front ottoman link 86 and the rear ottoman link 104 on the seat plate 38 (pivot points 88 and 106) are moved as high on seat plate as possible, allowing the ottoman 22 to move higher in the TV and reclined positions. This is all achieved in an all-linkage mechanism 18, without the need for any track-and-roller design. By using an all-linkage design, the mechanism 18 avoids an area in which debris can gather (in the tracks) and reduces maintenance issues often experienced with a track-and-roller design.

Figure 23:
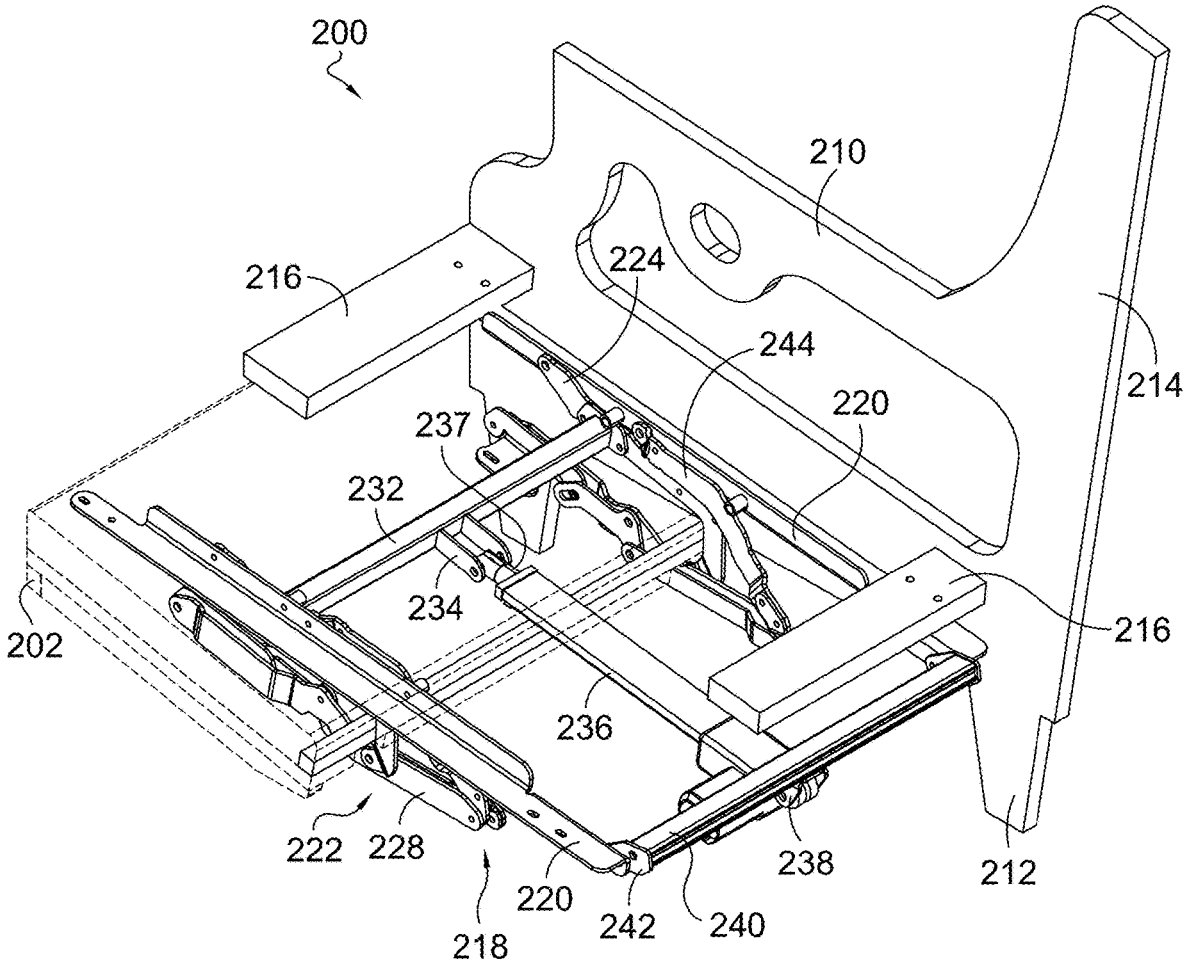
FIG. 23 is a partial perspective view of an alternative aspect of a chair and mechanism, where the ottoman is extendable while the seat and back remain stationary.
Figure 24:
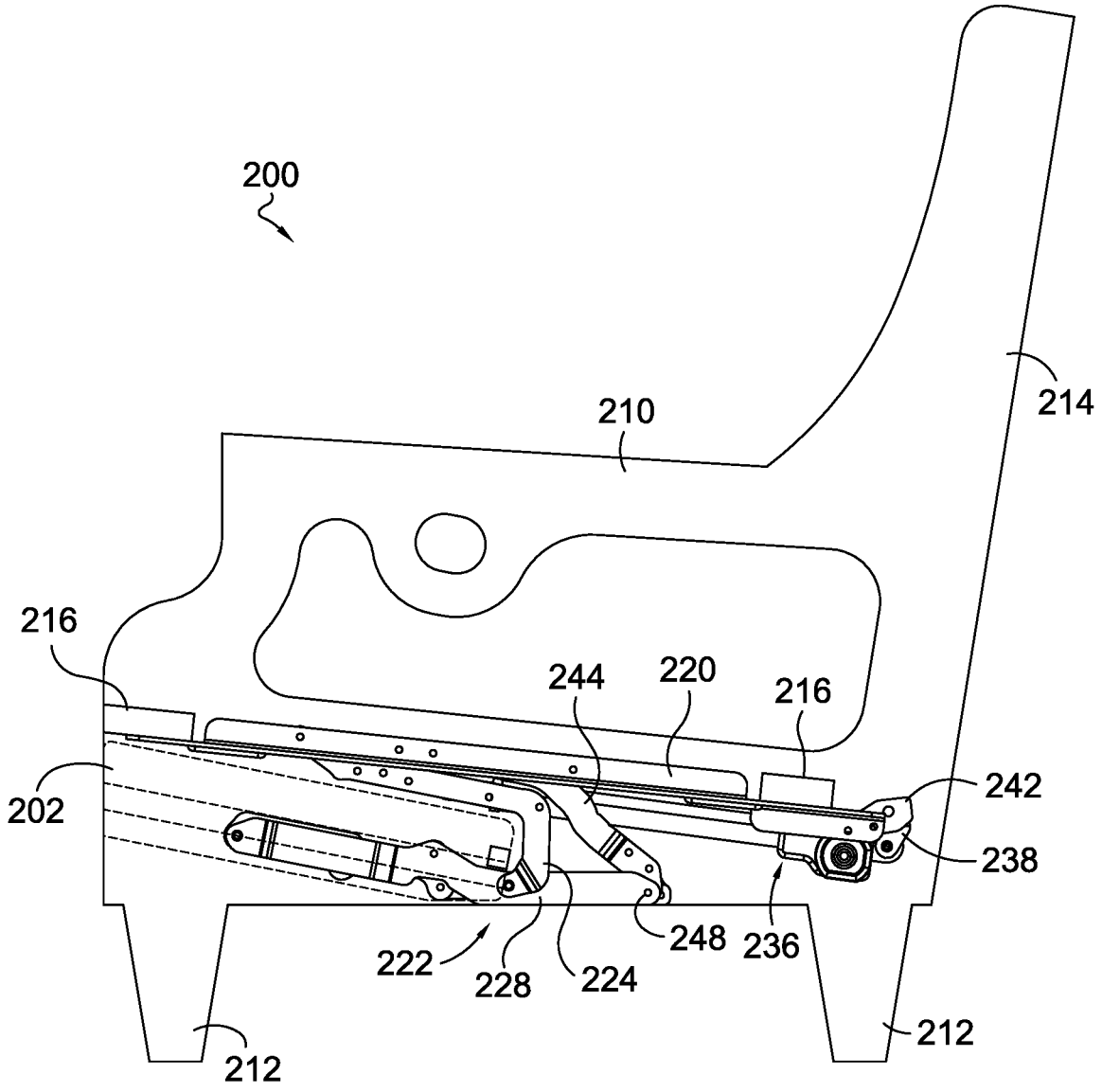
FIG. 24 is a side elevation view of the chair and mechanism of FIG. 23.
Figure 25:
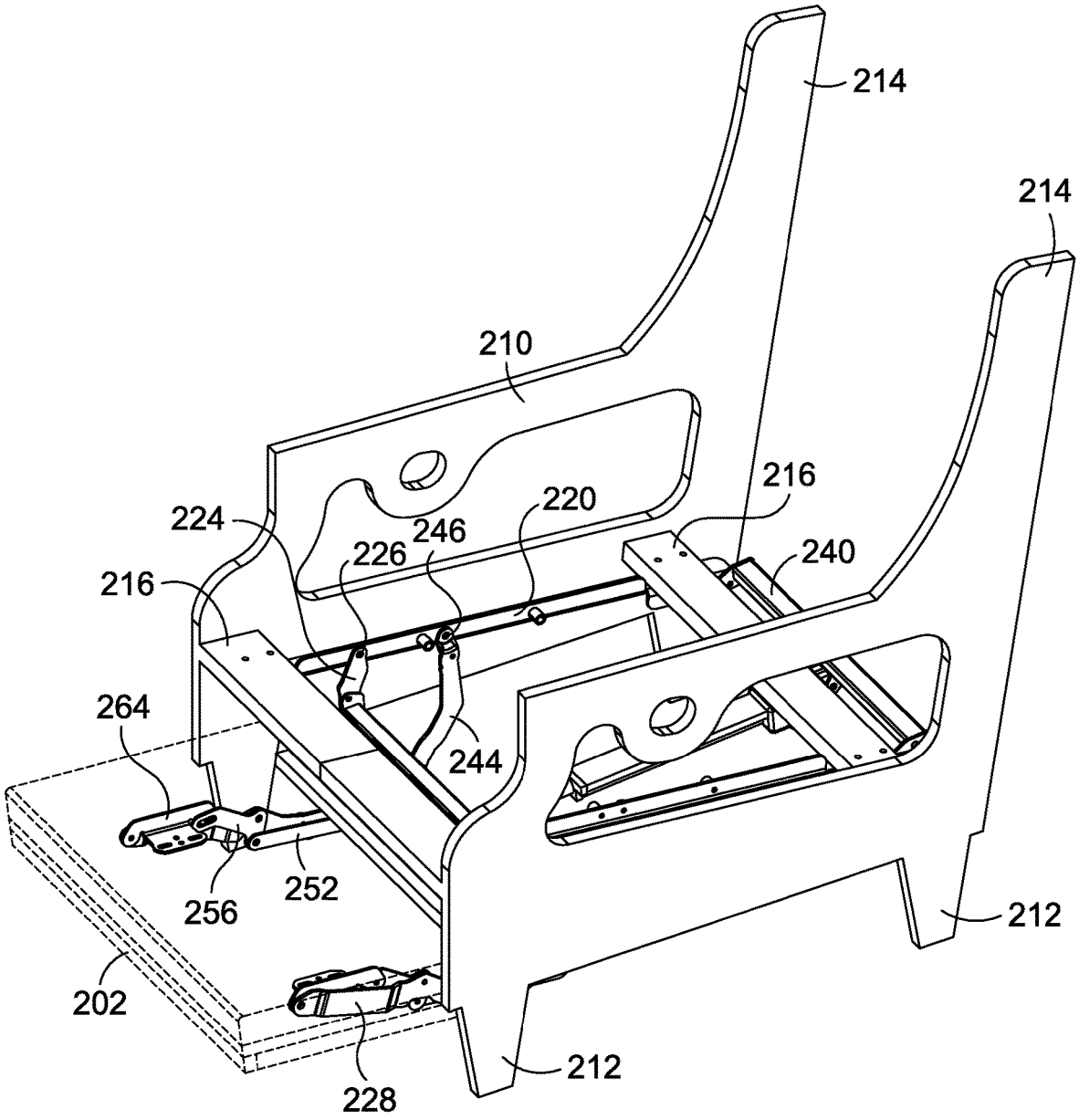
FIG. 25 is a partial perspective view of the chair and mechanism of FIG. 23, shown from a different perspective, and in an intermediate laptop position.
Figure 26:
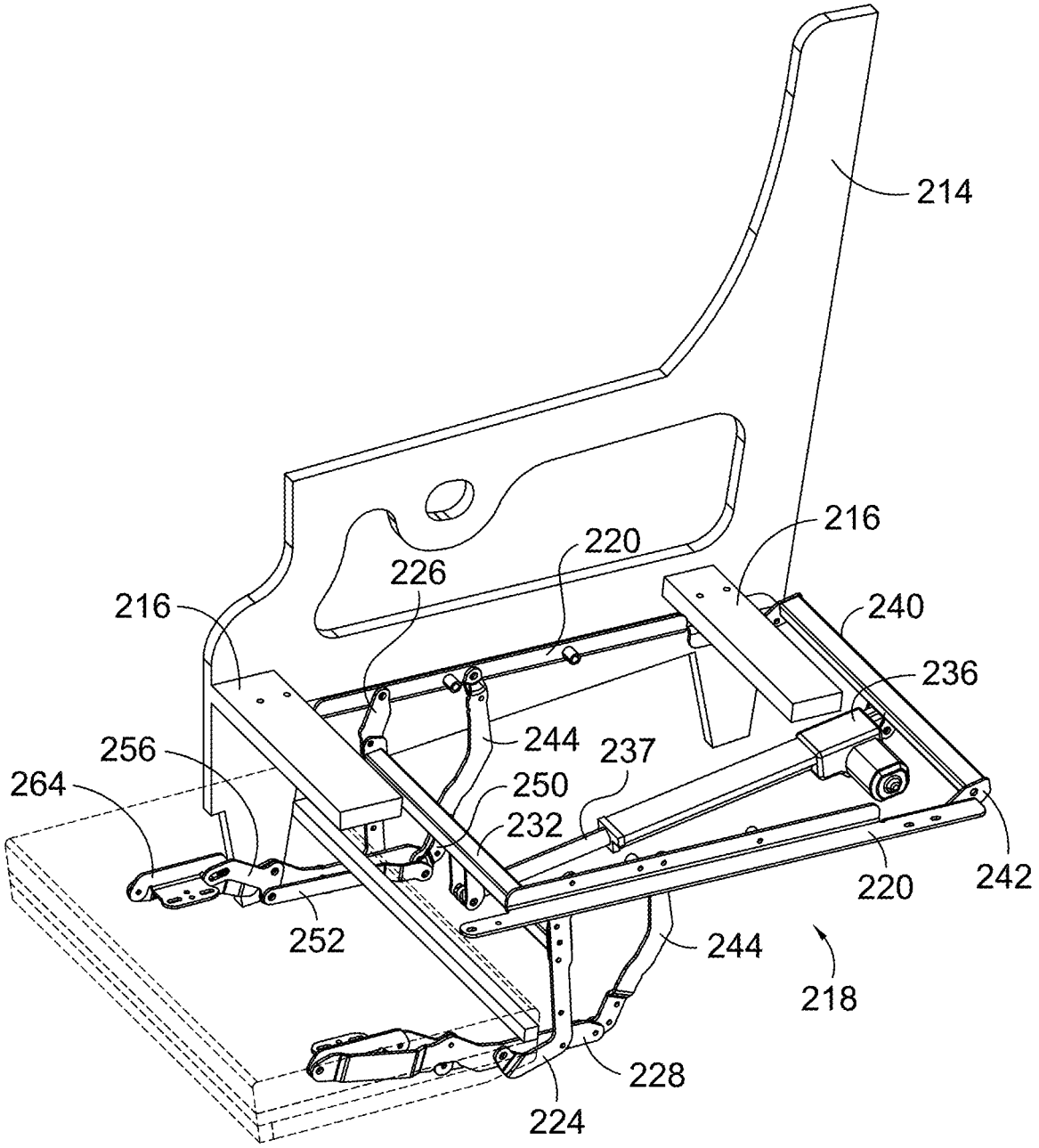
FIG. 26 is a view similar to FIG. 25, but shown with one arm panel hidden.

In an alternative embodiment, as shown in FIGS. 23-32, a chair 200 having a stationary seat and back may be provided, with a moveable ottoman 202 (shown as transparent to reveal other links). FIGS. 23-24 depict the chair 200 in a closed position, FIGS. 25-28 depict the chair 200 in an intermediate laptop position, and FIGS. 29-32 depict the chair 200 in an extended or TV position. The chair 200 is shown without upholstery on the arms and back, and without the seat, for simplicity. The chair 200 may include a pair of spaced apart arm panels 210, which may, in some aspects, include integral legs 212 and a back frame 214. The arm panels 210 are shown as a wooden frame that would in practice have padding and upholstery, which is not shown here for the sake of simplicity. While the arm panels 210 are shown as having a stylistic shape, it should be understood that other shapes and styles could be used. As shown, the bottoms of the arm panels 210 may be suspended above the floor by the legs 212, in a styling known as "high-leg". The arm panels 210 may be coupled to one another by cross-braces 216, which may also provide support for a padded seat (not shown) for the chair 200. The chair 200 further includes a mechanism 218 coupling the ottoman 202 to the cross-braces 216. The mechanism 218 controls the movement of the ottoman 202 between the closed position (FIGS. 23-24), the laptop position (FIGS. 25-28) and the extended or TV position (FIGS. 29-32), as further described below. While depicted as three distinct positions, in practice a user could position the chair 200 in any position between the closed position and the TV position.

Figure 28:
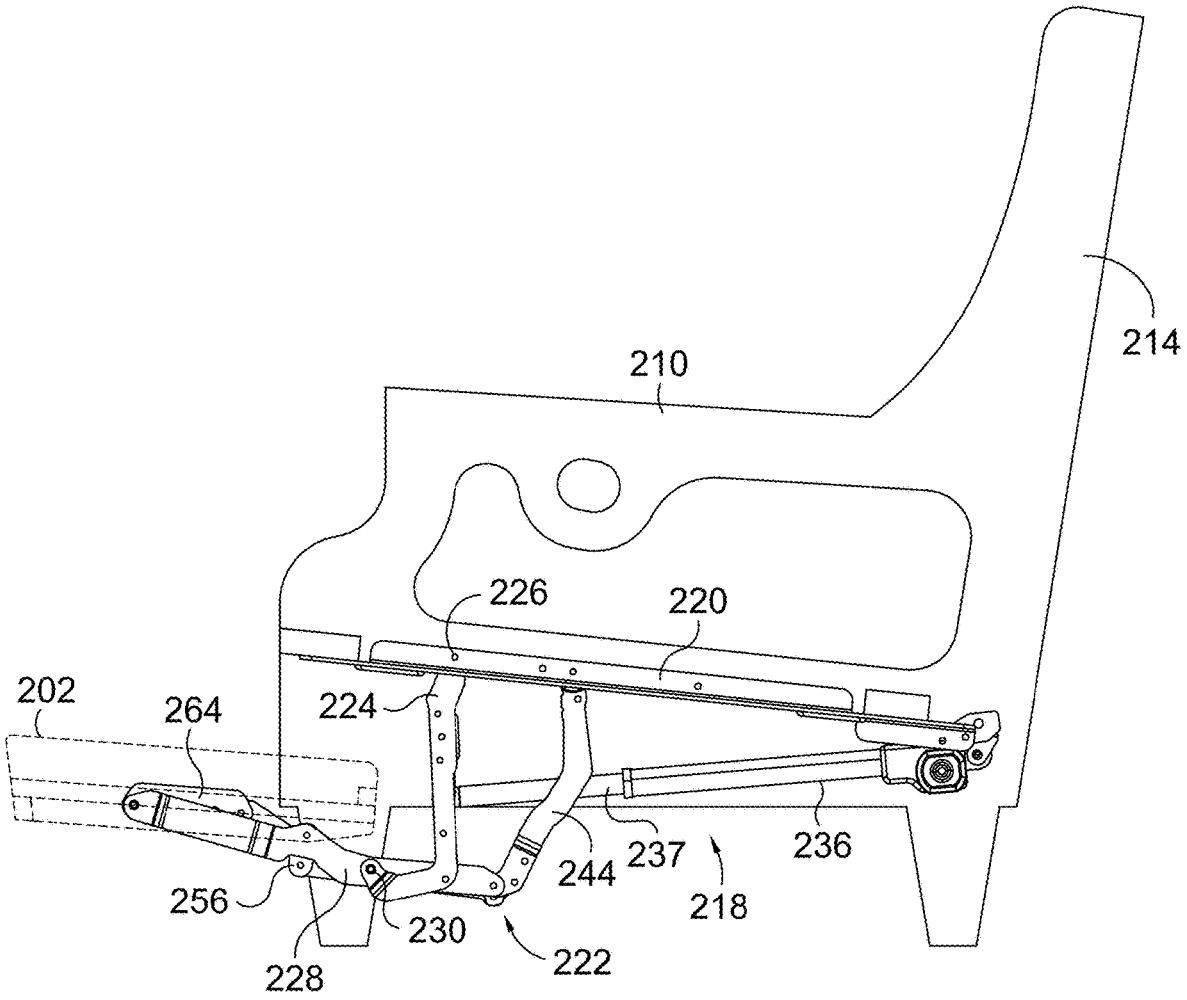
FIG. 28 is a side view of FIG. 26.
Figure 29:
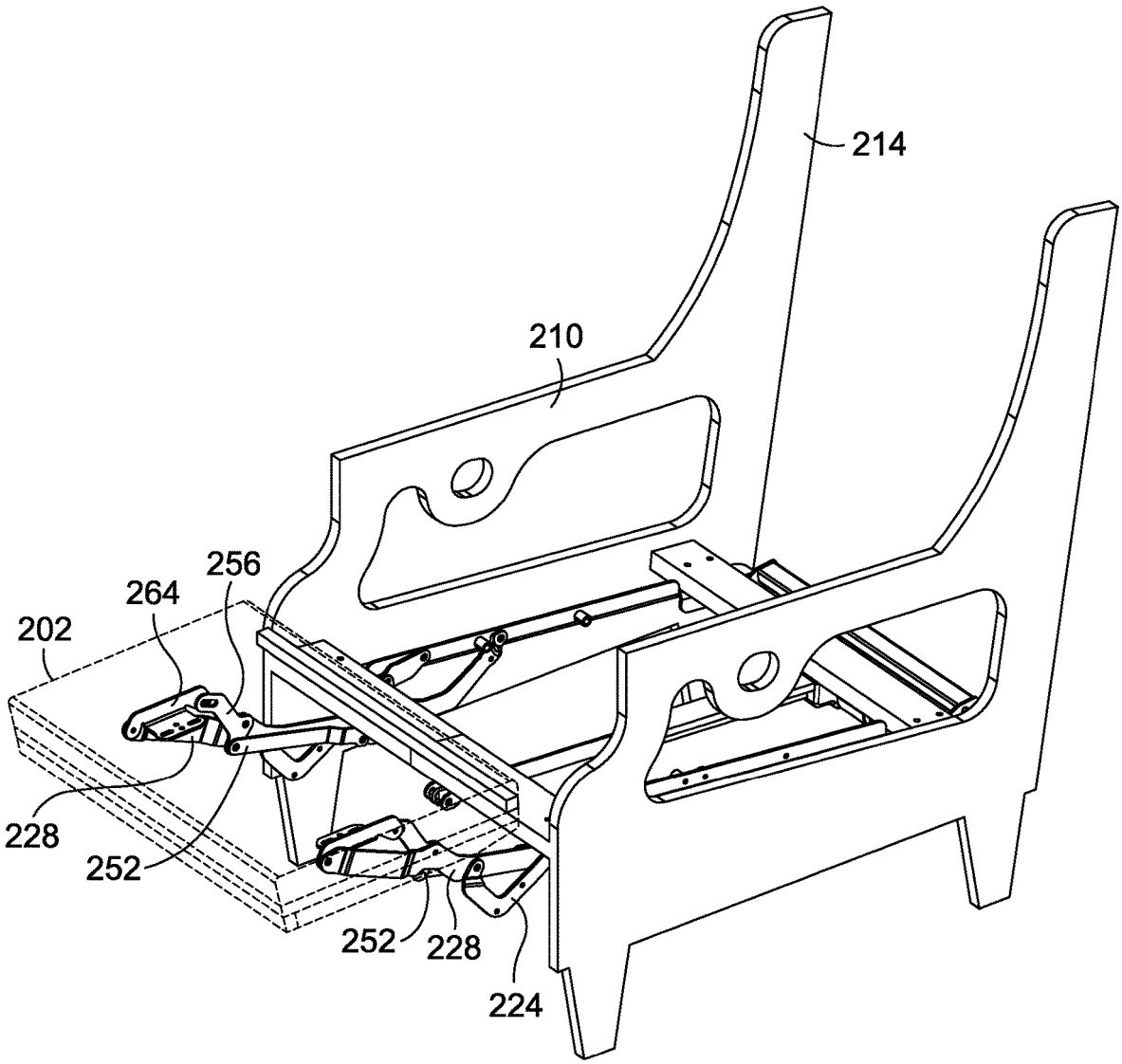
FIG. 29 is a partial perspective view similar to FIG. 25, from a slightly different perspective, and in an extended position.

In this movement, the mechanism 218 moves the ottoman 202 from the closed position, such as that shown in FIG. 24, to the laptop position, such as that shown in FIG. 28, with the top face of the ottoman facing in an upward direction throughout the movement. This improved motion of the ottoman 202 allows for usable positions between the closed position and the TV position (such as the laptop position). In some aspects, the mechanism 218 moves the ottoman 202 while maintaining a slight angle with respect to the floor, rising from the back of the ottoman 202 to the front of the ottoman 202, for comfortable support of a user's feet. In some aspects, this angle can range between 5-15 degrees, although other angles could also be implemented. In some aspects, the mechanism 218 allows the linkage carrying the ottoman 202 to be located inwardly, with respect to outer edges of the ottoman 202, for a better aesthetic. As shown in FIG. 24, the mechanism 218 allows use on a high-leg chair with a clean bottom line (with the mechanism 218 hidden from view by the bottom of the arm panels 210). Still further, the design of the mechanism 218 allows the ottoman 202 to span the full width of the seat for the full depth of the ottoman 202. In some aspects, the mechanism 218 moves the ottoman 202 to the TV position with the back of the ottoman 202 spaced from the front of the seat less than that requiring the use of a mid-ottoman support.

The mechanism 218 includes a pair of mounting plates 220 coupled to cross-braces 216 inwardly from the arm panels 210. Each mounting plate 220 carries an ottoman linkage 222 that extends between the mounting plate 220 and the ottoman 202. The ottoman linkages 222 are spaced apart from one another and are spaced inwardly from the outer edges of the ottoman 202.

Figure 27:
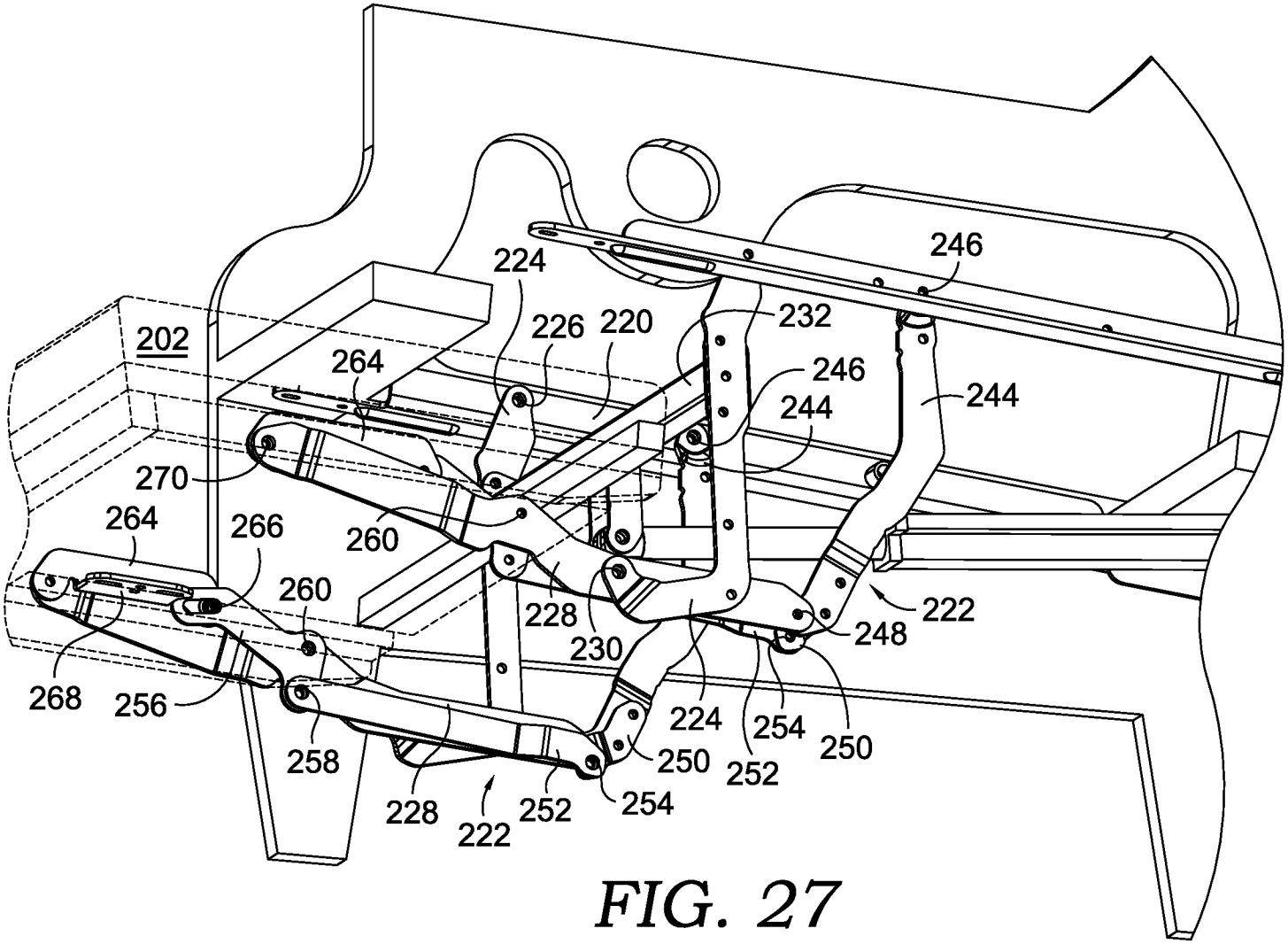
FIG. 27 is an enlarged view of a portion of FIG. 26, from a different perspective.

As seen in FIGS. 27 and 28, the ottoman linkage 222 includes a front ottoman link 224 pivotally coupled to the mounting plate 220 at pivot point 226. The overall shape of the front ottoman link 224 is best seen in FIG. 27. The hook end of the front ottoman link 224 (the end opposite pivot point 226) is pivotally coupled to a main ottoman link 228 at pivot point 230. As best seen in FIG. 24, the shape of hook end of the front ottoman link 224 allows it to be routed around the ottoman 202 in the closed position. In some aspects, the pivot point 230, in the closed position, is behind the back of the ottoman 202, in the closed position. The shape of the front ottoman link 224, in part, allows the ottoman 202 to fit below the seat in the closed position, and allows the links in the mechanism 218 to fit above the bottom of the arm panels 210.

Figure 30:
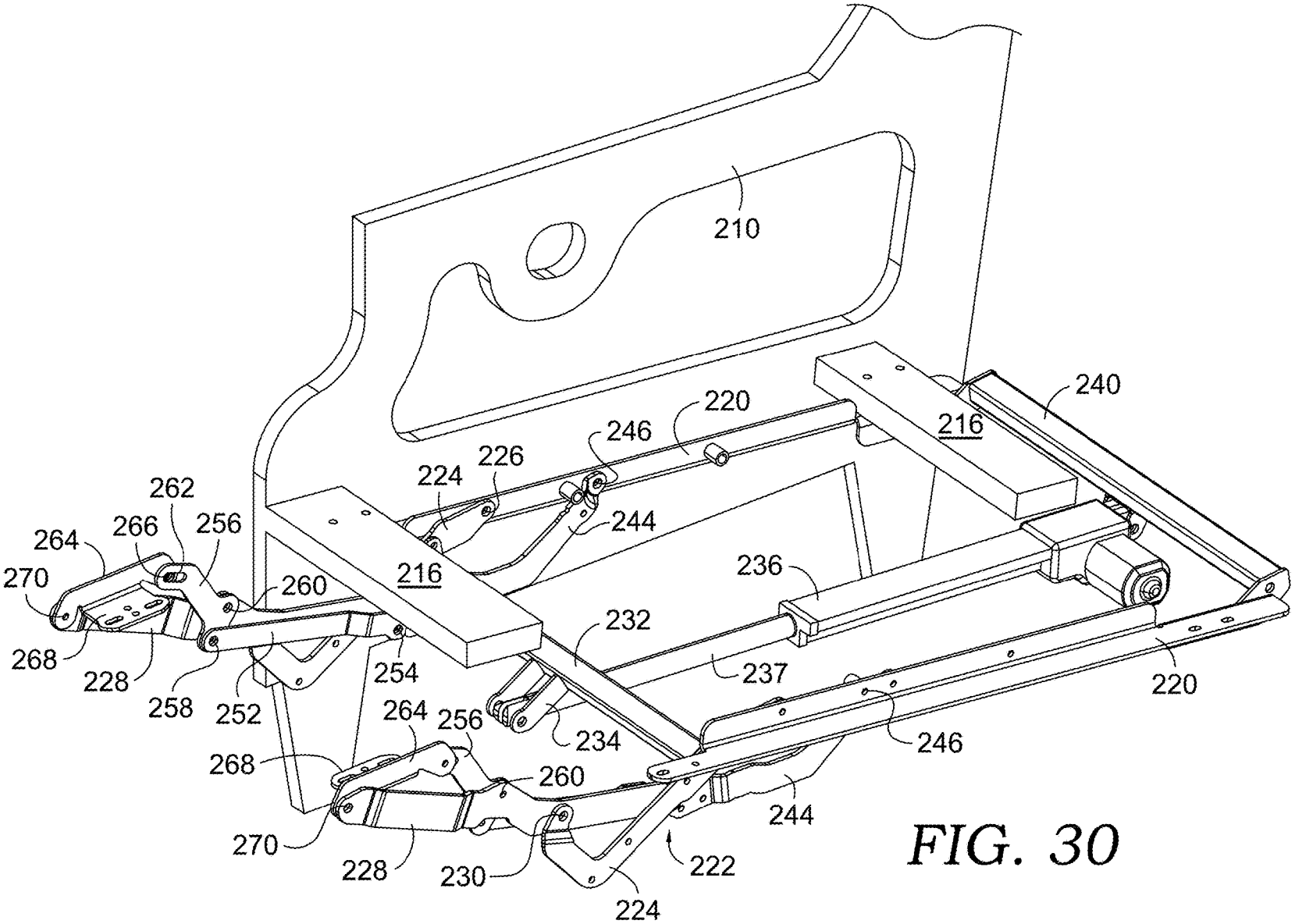
FIG. 30 is an enlarged partial perspective view in the position of FIG. 29, but shown with the ottoman hidden.
Figure 31:
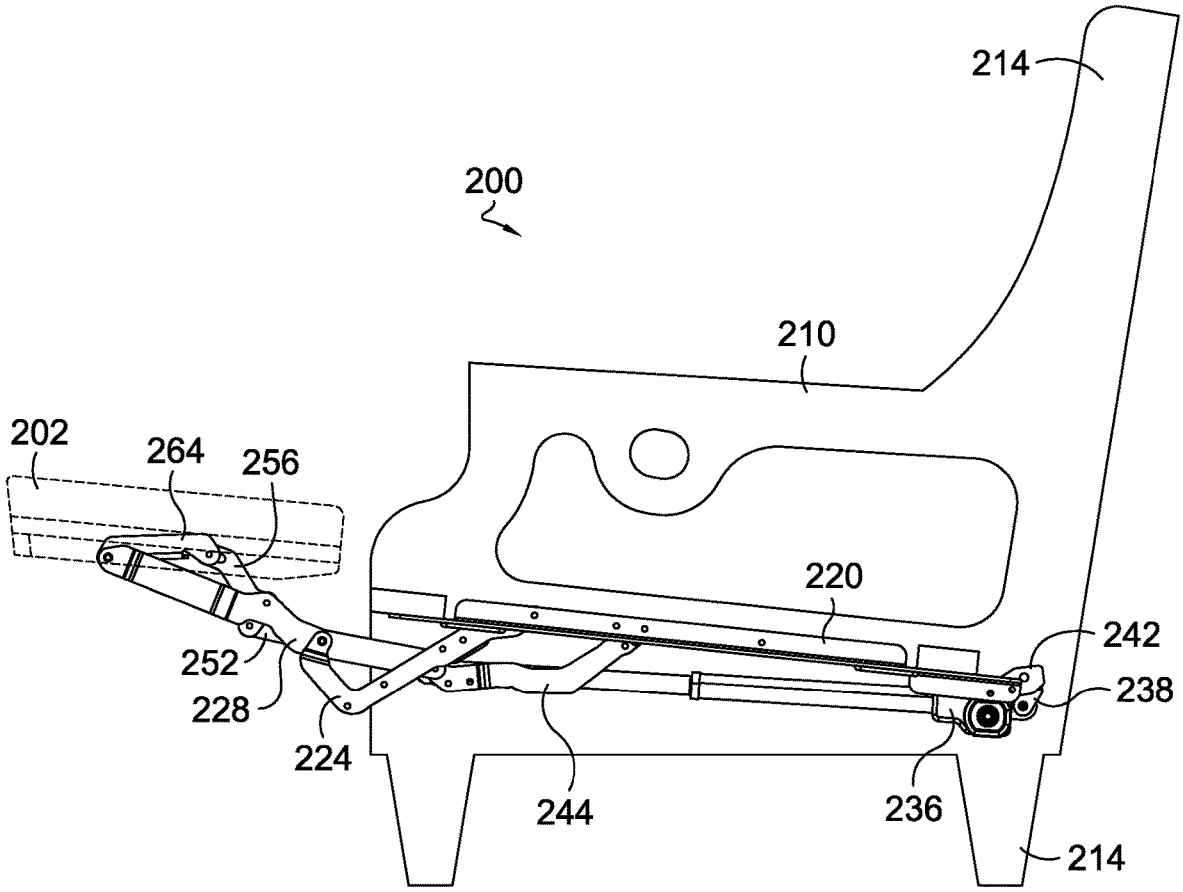
FIG. 31 is a side view of FIG. 29 with one arm panel hidden.

As seen in FIG. 23, the front ottoman links 224 are coupled to one another via a front motor tube 232 that is rigidly coupled on each end to a respective front ottoman link 224. As seen in FIG. 30, the front motor tube 232 supports a bracket 234 that is rigidly coupled to the front motor tube 232. One end of a motor 236 (such as a linear actuator) is pivotally coupled to the bracket 234. The motor 236 has an extendable shaft 237, the end of which is coupled to bracket 234. As seen in FIG. 23, the opposite end of the motor 236 is pivotally coupled, through a bracket 238, to a rear motor tube 240. The rear motor tube 240 spans between the mounting plates 220 and is fixedly coupled to each mounting plate 220. In some aspects, the rear motor tube 240 is coupled to each mounting plate 220 through an intervening, fixed bracket 242.

Figure 32:
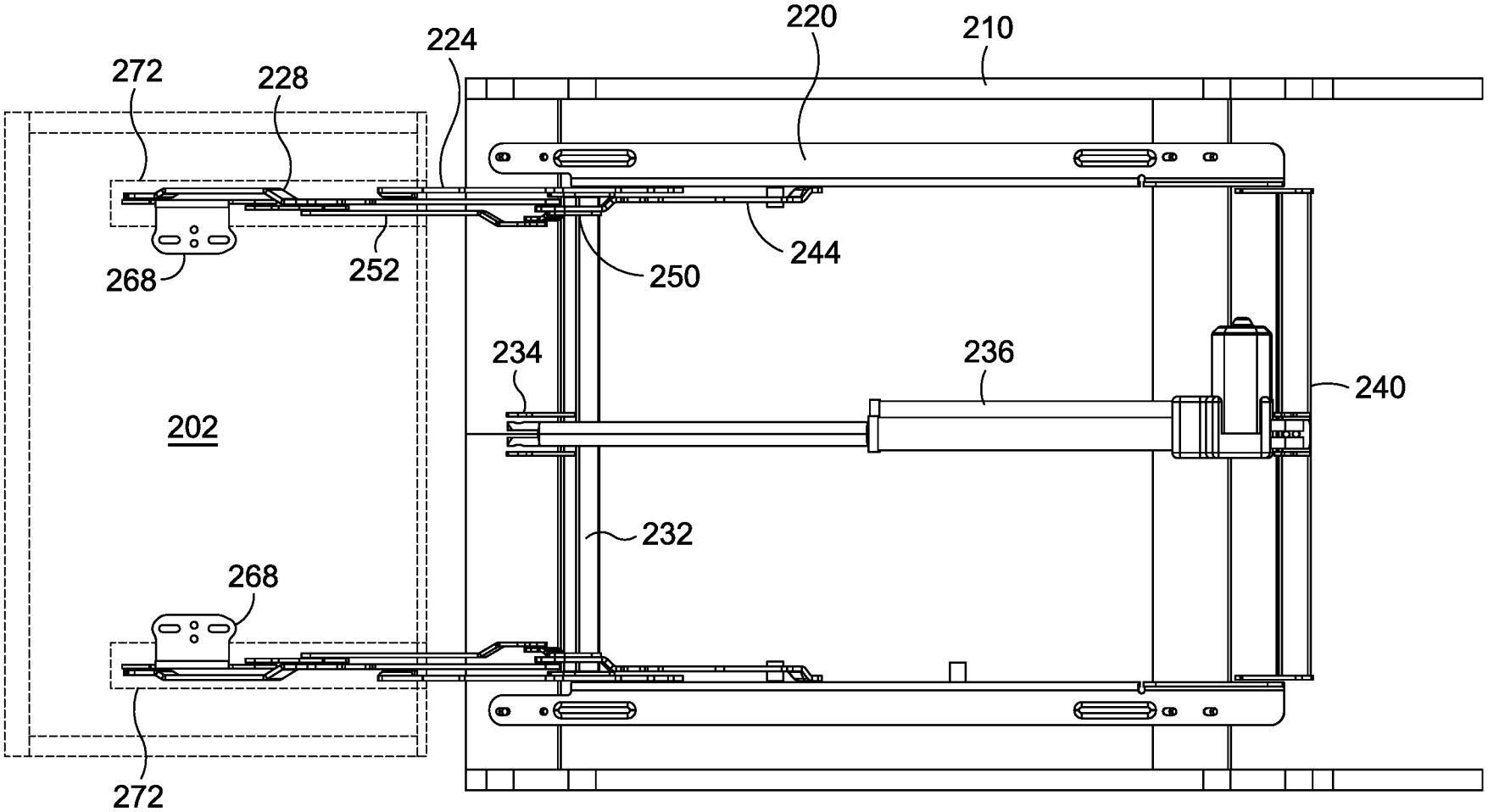
FIG. 32 is a bottom plan view in the extended position.

Returning to FIGS. 27 and 30, a rear ottoman link 244 is pivotally coupled to the mounting plate 220 at pivot point 246. The rear ottoman link 244 extends away from pivot point 246, and it is pivotally coupled at the end opposite pivot point 246 to the main ottoman link 228 at pivot point 248. As best seen in FIG. 27, a rear ottoman bracket 250 is fixedly coupled to the lower end of the rear ottoman link 244, on the inner side of the rear ottoman link 244. The rear ottoman bracket 250 has a lower end that is pivotally coupled to an ottoman pitch control link 252 at pivot point 254. As best seen in FIG. 27, the rear ottoman bracket 250 allows the effective pivotal coupling of the rear ottoman link 244 to both the main ottoman control link 228 (at pivot point 248) and the ottoman pitch control link 252 (through rear ottoman bracket 250 at pivot point 254), even though pivot point 248 is close in proximity to pivot point 254. As best seen in FIGS. 27 and 30, the end of the ottoman pitch control link 252 opposite pivot point 254 is pivotally coupled to an ottoman bellcrank 256 at pivot point 258. Near pivot point 258, the ottoman bell crank 256 is also pivotally coupled to the main ottoman link 228 at pivot point 260. As best seen in FIG. 30, the ottoman bellcrank 256 includes a slot 262. Through the slot 262, the ottoman bellcrank 256 is coupled to a footrest bracket 264 at point 266, allowing the point 266 to move within the slot 262. The footrest bracket 264 may include a flange 268 that is used to couple the ottoman 202 to the footrest bracket 264. The outer end of the footrest bracket 264 is pivotally coupled to the outer end of the main ottoman link 228 at pivot point 270. Portions of the footrest bracket 264 extend into the ottoman 202. As seen in FIG. 32, a lower support board (e.g., a position of which is outlined by dashed lines) of the ottoman 202 may be slotted (see slots 272) to accommodate portions of the ottoman linkage 222. Together, the ottoman pitch control link 252 and the ottoman bellcrank 256 control the pitch, or orientation, of the ottoman 202 as it moves from the closed position to the TV position (and positions therebetween). In some aspects, the angle of the ottoman 202 is between 5-15 degrees in the laptop position, allowing a user to comfortably rest their feet on the ottoman 202.

As shown in FIG. 32, the mechanism 218 allows for the ottoman 202 to extend the full width of the seat, for the entire length (from the back of the chair 200 towards the front of the chair 200) of the ottoman 202. This is achievable, in part, due to the shape of the front ottoman link 224 as the hook end of the front ottoman link 224 extends around the ottoman 202 in the closed position. The mechanism 218 also moves the ottoman 202, in the TV and reclined position, to a position relative to the seat such that a mid-ottoman support is not needed. In other words, the gap between the front of the seat and the back of the ottoman is less than a distance requiring a mid-ottoman.

In the closed position, the mechanism 218 allows a clean front edge of the chair 200, with the front of the ottoman 202 in line with the front of the chair 200, as seen in FIG. 24. As the motor 236 extends, it acts on the front ottoman links 224. The motor 236 can be stopped at any of an infinite number of positions, between the closed position and the TV position, including the laptop position of FIGS. 25-28. Because the mechanism 218 moves the ottoman 202 with the top face of the ottoman 202 generally facing upward for the entire motion, the positions of the ottoman 202 between the closed position and the TV position are usable, if desired. It has been found that an intermediate position, (such as that shown in FIGS. 25-28) with the ottoman 202 facing up, but with the top face of the ottoman 202 below the top of the seat, is comfortable when a user rests his or her feet on the ottoman 202 (e.g., the laptop position).

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed:

1. A motorized mechanism for a seating unit having a seat and a back, comprising:

a mounting rail coupled to a portion of the seating unit;

an ottoman linkage pivotally coupled to the mounting rail;

an ottoman coupled to the ottoman linkage, the ottoman having a top face, a bottom, a front, a rear and opposing sides extending from the front to the rear;

a motor coupled to the ottoman linkage, the motor having an extendable shaft operable to at least articulate the ottoman linkage to move the ottoman from a closed position with the ottoman below the seat to an extended position with the ottoman forward of the seat;

wherein the ottoman linkage controls the movement of the ottoman from the closed position to the extended position with the top face of the ottoman facing upwardly throughout the movement; and wherein the motor is operable to stop at an intermediate position between the closed position and the extended position, and the motor and the ottoman linkage hold the ottoman in the intermediate position, with the ottoman below the seat and at least the front of the ottoman in front of the seat.

2. The mechanism of claim 1, wherein, in at least the intermediate position, the top face of the ottoman is inclined from the back of the ottoman to the front of the ottoman.

3. The mechanism of claim 2, wherein the angle of the incline of the ottoman is between zero and fifteen degrees relative to horizontal.

4. The mechanism of claim 1, wherein, in at least the intermediate position, the top face of the ottoman is declined from the back of the ottoman to the front of the ottoman.

5. The mechanism of claim 1, wherein the ottoman linkage is coupled to the bottom of the ottoman at a location spaced inwardly from the sides of the ottoman.

6. The mechanism of claim 5, wherein the sides of the ottoman define a width, and wherein the width is constant from the back of the ottoman to the front of the ottoman.

7. The mechanism of claim 6, wherein the ottoman comprises a lower support board, the lower support board having a pair of slots spaced inwardly from the sides of the ottoman, the slots accommodating a portion of the ottoman linkage.

8. The mechanism of claim 1, wherein the ottoman linkage comprises a front ottoman link having a first portion pivotally coupled to the mounting rail and a second portion having a hook shape extending away from the first portion; and wherein, in the closed position, the first portion of the front ottoman link is adjacent the top face of the ottoman and the second portion extends around the back of the ottoman.

9. The mechanism of claim 8, wherein the second portion of the front ottoman link is pivotally coupled to a main ottoman link, and wherein the pivot point of the second portion of the front ottoman link and the main ottoman link is located rearwardly of the back of the ottoman when the ottoman is in the closed position.

10. The mechanism of claim 9, wherein the ottoman linkage further comprises:

a rear ottoman link having a first end coupled to the mounting rail and a second end;

an ottoman support bracket fixedly coupled to the ottoman;

the main ottoman link being pivotally coupled to the ottoman support bracket, the second portion of the front ottoman link and the second end of the rear ottoman link.

11. The mechanism of claim 10, wherein the ottoman linkage further comprises an ottoman bellcrank, a pitch control link and a rear ottoman bracket; wherein the ottoman bellcrank is pivotally coupled to the ottoman support bracket, the main ottoman link and a first end of the pitch control link;

a second end of the pitch control link is pivotally coupled to the rear ottoman bracket, the pivot point of the pitch control link and the rear ottoman bracket being proximate the pivot point of the rear ottoman link and the main ottoman link.

12. The mechanism of claim 1, wherein the seating unit includes stationary arms, and wherein the seating unit has a stationary seat and back, and wherein the mounting rail is fixedly coupled to the seating unit and does not move with respect to the arms or the seat.

13. The mechanism of claim 1, wherein the mechanism further comprises a linkage coupled to the ottoman linkage, the seat and the back, and wherein the motor is operable to move the seating unit between the closed position, the extended position, and a fully-reclined position.

14. The mechanism of claim 13, wherein the mounting rail is coupled to the seat of the seating unit.

15. The mechanism of claim 1, wherein the seating unit includes arms having a bottom that is spaced above the floor on which the seating unit sits, and wherein the mechanism fits between the seat and the bottom of the arms, such that the mechanism is obscured from view in the closed position.

16. The mechanism of claim 1, wherein, in the closed position, the mechanism has a vertical span from the bottom extent of the mechanism to the top extent of the mechanism, and wherein the span is less than eight inches.

17. The mechanism of claim 16, wherein, in the extended position, the rear of the ottoman is spaced from the front of the seat by a distance of less than five inches.

18. The mechanism of claim 1, wherein the ottoman linkage comprises an all-linkage assembly.

19. A mechanism for a seating unit having a pair of spaced apart arms, a seat, a back, an ottoman, the mechanism operable to move the seating unit between closed, extended and fully reclined positions, the mechanism comprising:

an ottoman linkage comprising:

a front ottoman link pivotally coupled on one end to the seat;

a rear ottoman link pivotally coupled on one end to the seat;

a footrest bracket coupled to the ottoman; and an all-linkage assembly coupling the front ottoman link, the rear ottoman link and the footrest bracket;

a rear motor tube fixedly coupled with respect to the arms;

a motor coupled between the rear motor tube and the ottoman linkage, the motor having an extendable shaft operable to at least move the ottoman from a closed position with the ottoman below the seat to an extended position with the ottoman forward of the seat and to a fully reclined position with the ottoman forward of the seat and back reclined;

wherein the ottoman linkage controls the movement of the ottoman from the closed position to the extended position with a top face of the ottoman facing upwardly throughout the movement.

20. The mechanism of claim 19, wherein the arms have a bottom that is spaced above the floor on which the seating unit sits, and wherein the mechanism fits between the seat and the bottom of the arms, such that the mechanism is obscured from view in the closed position.

21. The mechanism of claim 20, wherein the front ottoman link comprises a first portion pivotally coupled to a portion of the seat and a second portion having a hook shape extending away from the first portion; and wherein, in the closed position, the first portion of the front ottoman link is adjacent the top face of the ottoman and the second portion extends around a back of the ottoman.

22. The mechanism of claim 21, wherein the all-linkage assembly comprises a main ottoman link, and wherein the second portion of the front ottoman link is pivotally coupled to the main ottoman link, and wherein the pivot point of the second portion of the front ottoman link and the main ottoman link is located rearwardly of the back of the ottoman when the ottoman is in the closed position.

* * * * *